US005848338A

United States Patent [19]

Okada

[11] Patent Number: 5,848,338

[45] Date of Patent: Dec. 8, 1998

[54] TONER REPLENISHING DEVICE AND TONER CARTRIDGE FOR USE THEREIN

[75] Inventor: Mitsuharu Okada, Osaka, Japan

[73] Assignee: Mita Industrial Co., Ltd., Osaka, Japan

[21] Appl. No.: 998,833

[22] Filed: Dec. 29, 1997

[30] Foreign Application Priority Data

| | | | |
|---|---|---|---|
| Jan. 17, 1997 | [JP] | Japan | 9-017712 |
| Jan. 17, 1997 | [JP] | Japan | 9-017713 |
| Mar. 5, 1997 | [JP] | Japan | 9-065593 |

[51] Int. Cl.[6] ..... G03G 15/08

[52] U.S. Cl. ..... 399/262; 399/119

[58] Field of Search ..... 399/27, 107, 110, 399/119, 258, 262; 222/DIG. 1

[56] References Cited

U.S. PATENT DOCUMENTS

| | | | |
|---|---|---|---|
| 4,752,807 | 6/1988 | Mort | 222/DIG. 1 X |
| 4,937,628 | 6/1990 | Cipolla et al. | 222/DIG. 1 X |
| 4,942,432 | 7/1990 | Mort et al. | 222/DIG. 1 X |
| 5,648,840 | 7/1997 | Ikunami et al. | 399/262 |
| 5,722,014 | 2/1998 | Fike | 399/119 |
| 5,734,953 | 3/1998 | Tatsumi | 399/262 |

*Primary Examiner*—Sandra Brase

*Attorney, Agent, or Firm*—Beveridge, Degrandi, Weilacher & Young, LLP

[57] ABSTRACT

A toner replenishing device including a mounting base having a toner replenishment opening formed for replenishing a hopper with a toner, and a toner cartridge to be mountable on the mounting base at a replenishing position at which the toner can be replenished through the toner replenishment opening. The mounting base is provided with a replenishment opening shutter member, and locking means for inhibiting the turning of the replenishment opening shutter member. When the toner cartridge is mounted at the replenishing position, locking of the locking means is released, and when the container is turned, a through-hole of the toner cartridge and the toner replenishment opening open.

36 Claims, 25 Drawing Sheets

TONER REPLENISHING DEVICE AND TONER CARTRIDGE FOR USE THEREIN

FIELD OF THE INVENTION

This invention relates to a toner replenishing device for replenishing a developing device with a toner in an image forming machine, such as an electrostatic copier, an electrostatic printer, or an electrostatic facsimile, and a toner cartridge for use in such a toner replenishing device.

DESCRIPTION OF THE PRIOR ART

In an image forming machine such as an electrostatic copier, an electrostatic printer or an electrostatic facsimile, a developing device is disposed, as is well known, for applying a toner to an electrostatic latent image to develop it to a toner image. In this developing device, the toner is consumed as development proceeds, and so a toner should be supplied where necessary. This toner supply is performed advantageously by loading a toner cartridge in the developing device, and discharging a toner in the toner cartridge into the developing device.

A typical example of a toner cartridge for supplying the developing device of an image forming machine with a toner is disclosed in Japanese Laid-Open Patent Publication Nos. 121470/87 and 102487/89. Such a toner cartridge has a container for accommodating a toner and a shutter mechanism disposed in a lower end part of the container. The shutter mechanism has a main member substantially integral with the container and having a through-hole formed therein, and a container shutter member disposed in the main member so as to be turnable relative to the main member between a closed position at which it closes the through-hole and an open position at which it opens the through-hole. In the container shutter member, rotation inhibited means is disposed for engagement with rotation inhibiting means disposed on the hopper side. On the hopper side of the developing device, a receiving portion is provided on which the toner cartridge is mounted removably. In this receiving portion, a toner replenishment opening is formed for replenishing the hopper with the toner. In this toner replenishing device, the rotation inhibited means of the container shutter member is engaged with the rotation inhibiting means on the hopper side to mount the toner cartridge at the replenishing position. Then, the container is turned 90° in a predetermined direction, whereby the container shutter member is relatively turned to the open position, at which it opens the through-hole, with respect to the main member. As a result, the toner in the container is discharged into the hopper through the through-hole and the toner replenishment opening.

In the conventional toner replenishing device of the above-described type, the receiving portion on which the toner cartridge is mounted removably is provided on the hopper side of the developing device. In this receiving portion, the toner replenishment opening is formed for replenishing the hopper with the toner. On this toner replenishment opening, a relatively thin plastic film having a plurality of radially extending notches formed therein, or a mesh plate having many small holes formed therein is disposed as a shutter member. Such a shutter member, however, did not exhibit a sufficient shielding function. Thus, not only during toner replenishment, but during other actions, things happened to fall into the hopper, or foreign matter sometimes contaminated the toner.

The conventional toner cartridge of the above-described type also has, in addition to, the main member substantially integral with the container and having the through-hole formed therein, the container shutter member disposed in the main member so as to be turnable relative to the main member between the closed position at which it closes the through-hole and the open position at which it opens the through-hole. Except during toner replenishment, the through-hole of the main member is closed with the container shutter member. However, the toner cartridge is not provided with locking means for reliably inhibiting the turn of the container shutter member. Consequently, if any vibration or load acts except during toner replenishment, as during transportation of the toner cartridge, the through-hole of the main member may open, thereby discharging the toner. This unexpected discharge of the toner contaminates the surroundings, or causes a waste of toner. An improvement has been demanded in the constitution of the toner cartridge involving these drawbacks.

SUMMARY OF THE INVENTION

An object of the present invention is to provide a novel and improved toner replenishing device which can sufficiently reliably prevent the fall of things into the hopper or the contamination of the toner by foreign matter.

Another object of the invention is to provide a novel and improved toner cartridge for use in a toner replenishing device which can sufficiently reliably prevent the fall of things into the hopper or the contamination of the toner by foreign matter.

Still another object of the invention is to provide a novel and improved toner cartridge which can sufficiently reliably prevent the unexpected discharge of toner except during toner replenishment.

According to an aspect of the invention, there is provided a toner replenishing device comprising a mounting base having a toner replenishment opening formed for replenishing a hopper with a toner, and a toner cartridge removably mounted on the mounting base at a replenishing position at which the toner can be replenished through the toner replenishment opening; the toner cartridge having a container for accommodating the toner, and a shutter mechanism disposed in a lower end part of the container; the shutter mechanism having a main member substantially integral with the container and including a bottom wall where a through-hole is formed, and a container shutter member including a bottom wall where a passage opening is formed, and being disposed outside the main member so as to be turnable relative to the main member between a closed position at which it closes the through-hole and an open position at which it opens the through-hole upon the alignment of the passage opening with the through-hole; the container shutter member having rotation inhibited means disposed for engagement with rotation inhibiting means disposed on the mounting base; wherein the mounting base is provided with a replenishment opening shutter member mounted so as to be turnable between a closed position at which it closes the toner replenishment opening and an open position at which it opens the toner replenishment opening, and locking means including a locking pin member movable between a locking position at which it inhibits the turn of the replenishment opening shutter member to hold the replenishment opening shutter member at the closed position, and a locking release position at which it allows the turn; the container shutter member has locking release means disposed thereon; and the main member has engaging means disposed which can engage engaged means disposed on the replenishment opening shutter member to turn the replenishment opening shutter member;

by engaging the rotation inhibited means of the container shutter member with the rotation inhibiting means of the mounting base, the toner cartridge is mounted at the replenishing position, whereby the locking release means of the container shutter member moves the locking pin member of the mounting base to the locking release position, and the engaging means of the main member is engaged with the engaged means of the replenishment opening shutter member; and by turning the container relative to the container shutter member, the container shutter member is turned relative to the main member to the open position, the replenishment opening shutter member is turned to the open position, and the through-hole and the toner replenishment opening align with each other.

In the above-described invention, the mounting base having the toner replenishment opening formed therein is provided with the replenishment opening shutter member, and the locking means for holding the replenishment opening shutter member at the closed position. When the toner cartridge is mounted at the replenishing position, the locking means is released. By turning the container, the through-hole of the toner cartridge is opened, and the replenishment opening shutter member is turned to the open position to open the toner replenishment opening. Thus, the fall of things into the hopper or the contamination of the toner by foreign matter is prevented sufficiently reliably. When this invention is applied to a hopper of the type which is slid relative to the body of an image forming machine and mounted there, the outward leakage of the toner in the hopper through the toner replenishment opening owing to vibrations during mounting, etc. can be prevented without fail. Thus, contamination of the surroundings or a waste of the toner is prevented. Consequently, disadvantages such as deterioration of developing function or damage to the developing device are prevented reliably, and formation of a satisfactory image is ensured.

The present invention also provides the toner replenishing device of the above constitution, further constituted such that an operating lever extending radially outwardly of the replenishment opening shutter member is disposed on the replenishment opening shutter member so as to be turnable integrally with the replenishment opening shutter member; the engaged means of the replenishment opening shutter member has an engaged portion to be engaged with the engaging means of the main member for an opening-direction turn for turning the replenishment opening shutter member from the closed position to the open position, and a free play space portion for permitting the closing-direction turn of the engaging means of the main member independently of the replenishment opening shutter member, the closing-direction turn being performed for turning the replenishment opening shutter member from the open position to the closed position; the closing-direction turn of the replenishment opening shutter member is performed by the operating lever.

In the above invention, the container is turned in the opposite direction after toner replenishment, whereby the through-hole of the toner cartridge is closed, while the replenishment opening shutter member is left at the open position. As a result, even if the remaining toner in the toner cartridge falls during the closure of the through-hole of the toner cartridge, the toner replenishment opening is open. Thus, the toner does not accumulate on the upper surface of the replenishment opening shutter member, so that the staining of the replenishment opening shutter member and its surroundings with the toner can be prevented. After the through-hole of the toner cartridge is closed, the replenishment opening shutter member can be turned to the closed position by the operating lever.

According to another aspect of the invention, there is provided a toner cartridge removably mounted on a mounting base; the mounting base having a toner replenishment opening formed for replenishing a hopper with a toner, and the mounting base being provided with a replenishment opening shutter member mounted so as to be turnable between a closed position at which it closes the toner replenishment opening and an open position at which it opens the toner replenishment opening, and locking means including a locking member movable between a locking position at which it inhibits the turn of the replenishment opening shutter member to hold the replenishment opening shutter member at the closed position, and a locking release position at which it allows the turn; the toner cartridge being removably mounted on the mounting base at a replenishing position at which the toner can be replenished through the toner replenishment opening; wherein the toner cartridge has a container for accommodating the toner, and a shutter mechanism disposed in a lower end part of the container; the shutter mechanism has a main member substantially integral with the container and having a through-hole formed therein, and a container shutter member disposed outside the main member so as to be turnable relative to the main member between a closed position at which it closes the through-hole and an open position at which it opens the through-hole; the container shutter member has rotation inhibited means disposed for engagement with rotation inhibiting means disposed on the mounting base; the container shutter member has locking release means disposed thereon; and the main member has engaging means disposed which can engage engaged means disposed on the replenishment opening shutter member to turn the replenishment opening shutter member;

by engaging the rotation inhibited means of the container shutter member with the rotation inhibiting means of the mounting base, the toner cartridge is mounted at the replenishing position, whereby the locking release means of the container shutter member moves the locking member of the mounting base to the locking release position, and the engaging means of the main member is engaged with the engaged means of the replenishment opening shutter member; and by turning the container relative to the container shutter member, the container shutter member is turned relative to the main member to the open position, the replenishment opening shutter member is turned to the open position, and the through-hole and the toner replenishment opening are aligned with each other.

In the above-described invention, the locking means is released when the toner cartridge is mounted at the replenishing position on the mounting base which has the toner replenishment opening formed therein and which is provided with the replenishment opening shutter member, and the locking means for holding the replenishment opening shutter member at the closed position. By turning the container, the through-hole of the toner cartridge is opened, and the replenishment opening shutter member is turned to the open position to open the toner replenishment opening. Thus, the toner cartridge of the present invention can be used preferably in a toner replenishing device which can sufficiently reliably prevent the fall of things into the hopper or the contamination of the toner by foreign matter.

According to still another aspect of the invention, there is provided a toner cartridge having engaging means disposed thereon and removably mounted on a mounting base; the mounting base having a toner replenishment opening formed for replenishing a hopper with a toner, and the mounting base being provided with a replenishment opening shutter member mounted so as to be turnable between a closed position at which it closes the toner replenishment opening and an open position at which it opens the toner replenishment opening, and locking means including a locking member movable between a locking position at which it inhibits the turn of the replenishment opening shutter member to hold the replenishment opening shutter member at the closed position, and a locking release position at which it allows the turn; the replenishment opening shutter member having engaged means and an operating lever disposed thereon; the operating lever extending radially outwardly and turnable integrally with the replenishment opening shutter member; the engaged means of the replenishment opening shutter member having an engaged portion to be engaged with the engaging means for an opening-direction turn for turning the replenishment opening shutter member from the closed position to the open position, and a free play space portion for permitting the closing-direction turn of the engaging means independently of the replenishment opening shutter member; the closing-direction turn being performed for turning the replenishment opening shutter member from the open position to the closed position; the closing-direction turn of the replenishment opening shutter member being performed by the operating lever; the toner cartridge being removably mounted on the mounting base at a replenishing position at which the toner can be replenished through the toner replenishment opening; wherein the toner cartridge has a container for accommodating the toner, and a shutter mechanism disposed in a lower end part of the container; the shutter mechanism has a main member substantially integral with the container and having a through-hole formed therein, and a container shutter member disposed outside the main member so as to be turnable relative to the main member between a closed position at which it closes the through-hole and an open position at which it opens the through-hole; the container shutter member has rotation inhibited means disposed for engagement with rotation inhibiting means disposed on the mounting base; the container shutter member has locking release means disposed thereon; and the main member has the engaging means disposed which can engage the engaged means of the replenishment opening shutter member to turn the replenishment opening shutter member;

by engaging the rotation inhibited means of the container shutter member with the rotation inhibiting means of the mounting base, the toner cartridge is mounted at the replenishing position, whereby the locking release means of the container shutter member moves the locking member of the mounting base to the locking release position, and the engaging means of the main member is engaged with the engaged means of the replenishment opening shutter member; and by turning the container relative to the container shutter member, the container shutter member is turned relative to the main member to the open position, the replenishment opening shutter member is turned to the open position, and the through-hole and the toner replenishment opening are aligned with each other.

By the same action as obtained by the toner cartridges of the previously described inventions, the toner cartridge of the foregoing invention can also be used preferably in a toner replenishing device which can sufficiently reliably prevent the fall of things into the hopper or the contamination of the toner by foreign matter.

According to a further aspect of the invention, there is provided a toner cartridge removably mounted on a mounting base having a toner replenishment opening formed for replenishing a hopper with a toner, the toner cartridge being mounted on the mounting base at a replenishing position at which the toner can be replenished through the toner replenishment opening; the toner cartridge having a container for accommodating the toner, and a shutter mechanism disposed in a lower end part of the container; the shutter mechanism having a main member substantially integral with the container and having a through-hole formed therein, and a container shutter member disposed outside the main member so as to be turnable relative to the main member between a closed position at which it closes the through-hole and an open position at which it opens the through-hole; wherein a locking member is disposed between the container shutter member and the main member so as to be axially movable between a locking position at which it inhibits the relative turning of the container shutter member and the main member and a locking release position at which it allows the relative turning of the container shutter member and the main member, and the locking member is moved axially upwardly to be brought from the locking position to the locking release position.

In the above invention, the locking member is disposed between the container shutter member and the main member. This locking member can lock them and inhibit their relative turns and release their locking. Thus, if any vibration or load works except during toner replenishment, as during transportation of the toner cartridge, the situation that the through-hole of the main member opens to discharge the toner can be prevented reliably. Since the unexpected discharge of the toner is prevented, neither the contamination of the surroundings nor waste of the toner takes place. Furthermore, the locking member is moved axially upward to be brought from the locking position to the locking release position. Hence, the receiving portion on the hopper side on which the toner cartridge is mounted removably is provided with a member for interfering with the locking member to move it relatively axially upwardly. By so doing, the locking of the container shutter member and the main member can be released. Hence, the through-hole of the main member does not open except during toner replenishment. However, the locking can be released at a touch for toner replenishment. Thus, the toner cartridge is excellent in operating properties, and small in the number of parts, so that it can be produced at a low cost.

DETAILED DESCRIPTION OF THE PREFERRED EMBODIMENTS

Preferred embodiments of a toner replenishing device and a toner cartridge for use therein that are constructed in accordance with the present invention will be described in detail by reference to the appended drawings.

Figure 1:
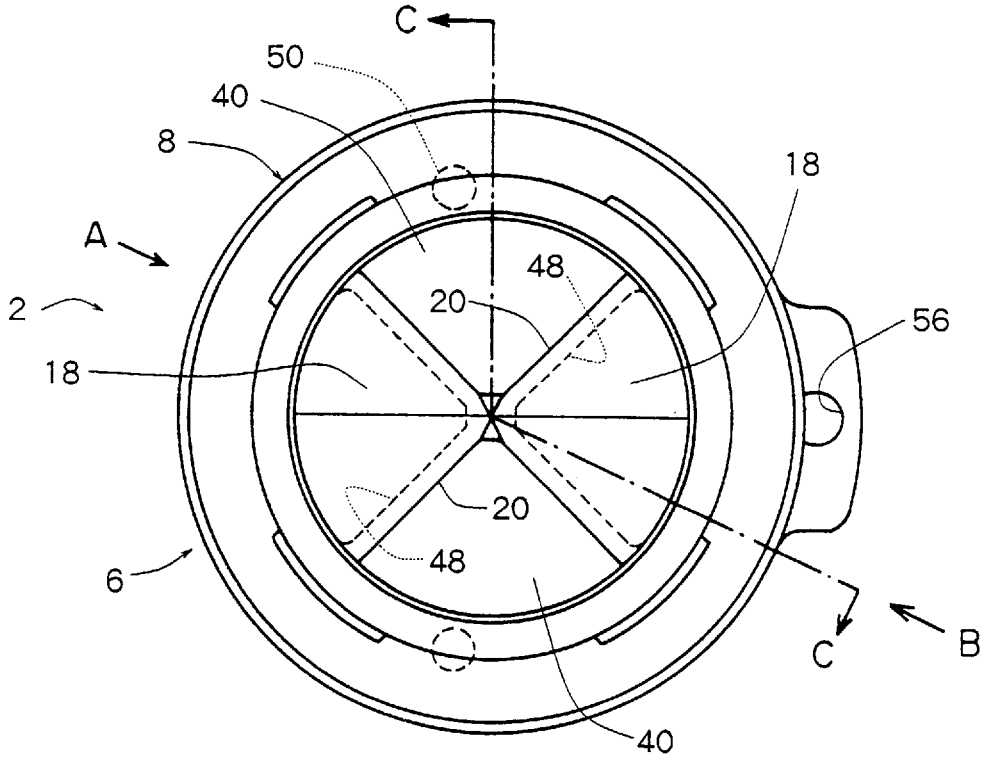
FIG. 1 is a plan view showing the essential part of a preferred embodiment of a toner cartridge constructed in accordance with the present invention.
Figure 2:
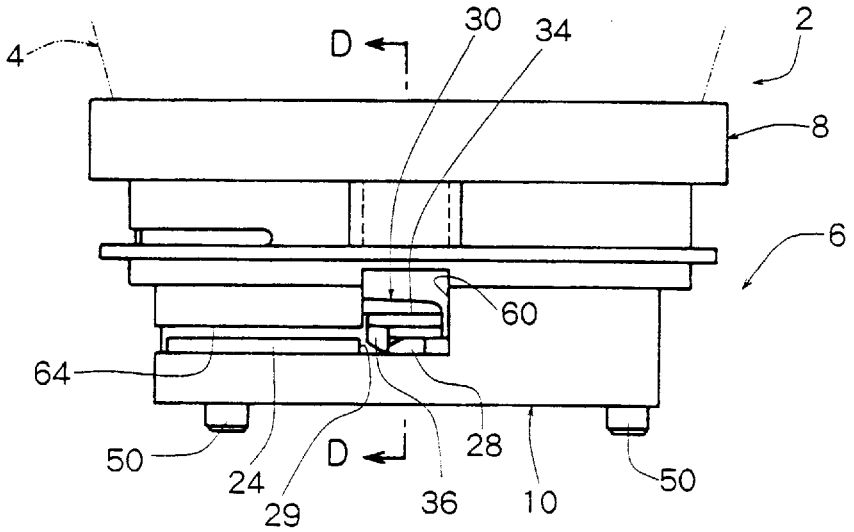
FIG. 2 is a view taken along line A of FIG. 1.
Figure 3:
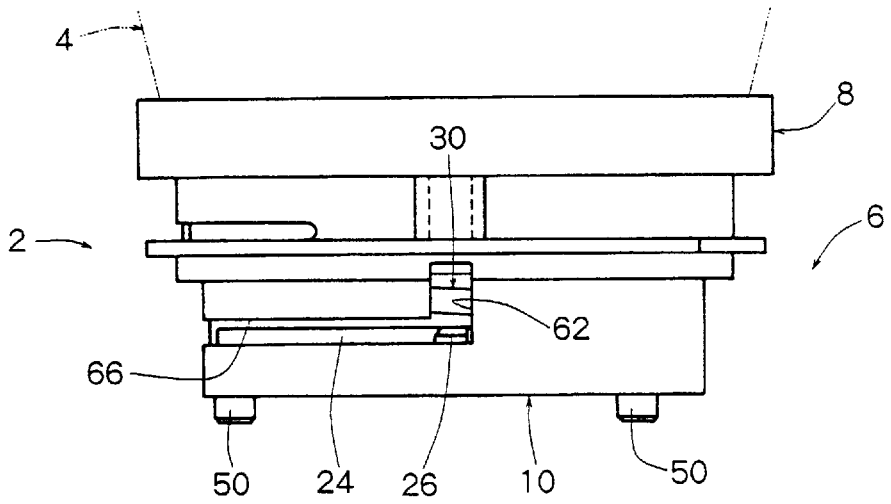
FIG. 3 is a view taken along line B of FIG. 1.
Figure 4:
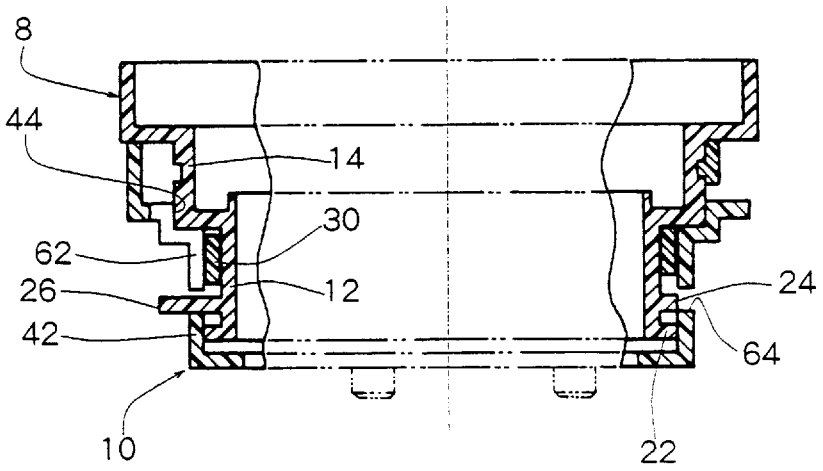
FIG. 4 is a sectional view taken on line C—C of FIG. 1.
Figure 5:
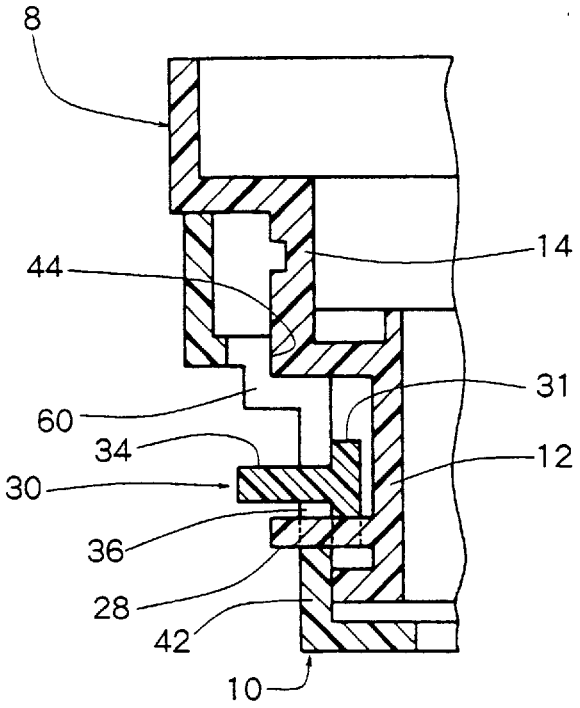
FIG. 5 is a sectional view taken on line D—D of FIG. 1.
Figure 6:
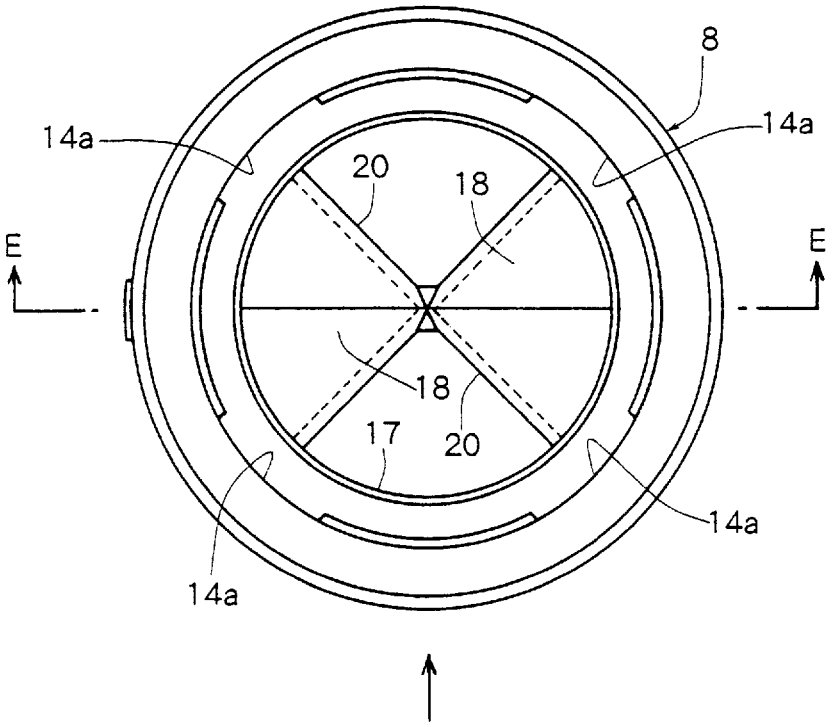
FIG. 6 is a plan view of a main member.
Figure 7:
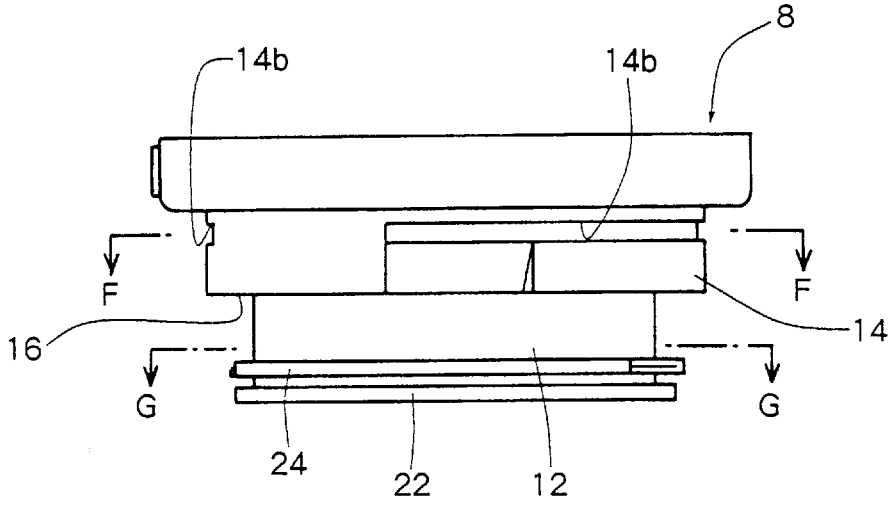
FIG. 7 is a side view of FIG. 6 as viewed from below.
Figure 8:
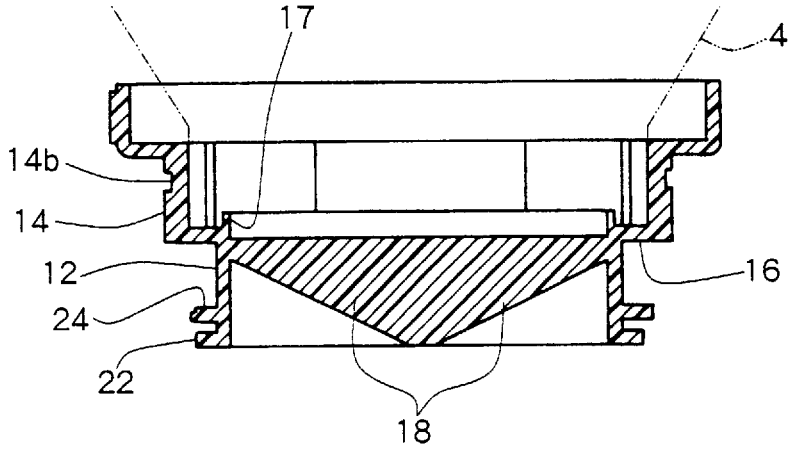
FIG. 8 is a sectional view taken on line E—E of FIG. 6.
Figure 9:
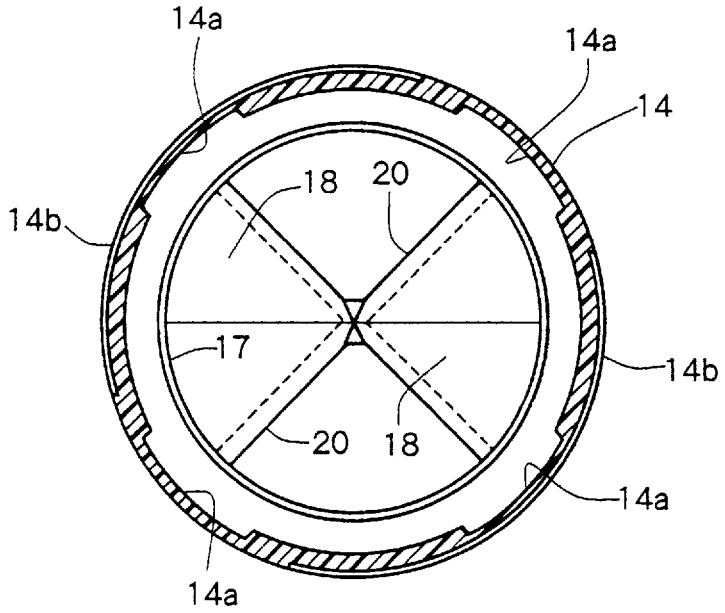
FIG. 9 is a sectional view taken on line F—F of FIG. 7.
Figure 10:
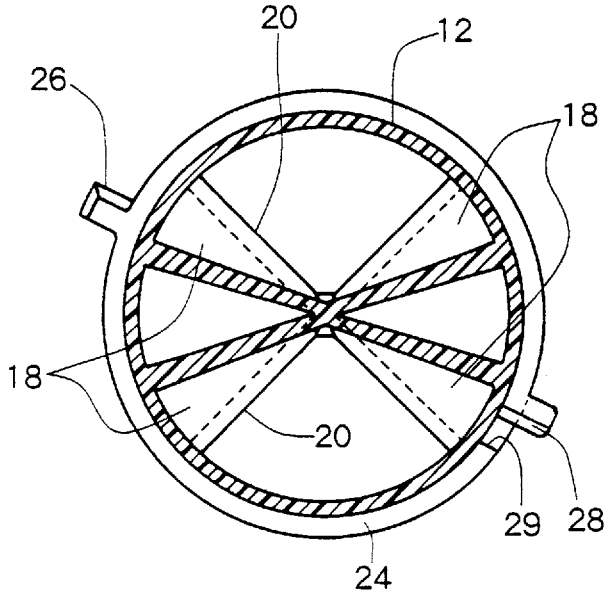
FIG. 10 is a sectional view taken on line G—G of FIG. 7.

FIGS. 1 to 3 show the essential part of a toner cartridge 2 constructed in accordance with the invention. The toner cartridge 2 has a container 4 for accommodating a toner, and a shutter mechanism 6 disposed in a lower end part of the container 4. The shutter mechanism 6 has a main member 8 force fitted into the lower end of the container 4 for integral coupling, and a container shutter member 10 disposed outside the main member 8.

Referring to FIGS. 6 to 10, the main member 8 which can be integrally molded from a plastic material such as ABS resin or PS resin is shaped like a cap as a whole. The main member 8 has a first cylindrical portion 12, and a second cylindrical portion 14 formed in an upper end part of the first cylindrical portion 12. The second cylindrical portion 14 has a larger diameter than the diameter of the first cylindrical portion 12, so that an annular stepped portion 16 is formed between the first cylindrical portion 12 and the second cylindrical portion 14. On the upper surface side of the stepped portion 16 and radially inwardly of the stepped portion 16, an annular portion 17 is formed which slightly protrudes axially upwardly in the main member 8. Between the annular portion 17 and the second cylindrical portion 14, an annular groove is formed. In the annular groove, a seal member (not shown) is disposed. Radially inwardly of the first cylindrical portion 12, a pair of bottom walls 18 are formed which each assume a substantially 90°-fan shape when viewed in the axial direction.

The respective bottom walls 18 are disposed at symmetrical positions with respect to the axis center of the main member 8, and are formed so as to continue to each other at the axis center. Radially inwardly of the first cylindrical portion 12 and at areas except the respective bottom walls 18, a pair of through-holes 20 are formed. The respective through-holes 20 are disposed at symmetrical positions with respect to the axis center of the main member 8, and each assume a substantially 90°-fan shape when viewed in the axial direction. Each of the bottom walls 18 has a horizontal, linear top portion passing through the axis center and reaching the radial inside of the first cylindrical portion 12, and an inclined surface lowering from the top portion toward both sides. A section of the bottom wall 18 in a direction perpendicular to its top portion is in a nearly V-shape, and the bottom surface of the bottom walls 18 in a nearly X-shape as a whole is positioned on substantially the same plane as the bottom surface of the first cylindrical portion 12.

In a lower end part of the outer peripheral surface of the first cylindrical portion 12, annular flanges 22 and 24 protruding radially outwardly are formed with spacing in the axial direction. In an outer peripheral part of the flange 24 situated axially upwardly, a turning engaging piece 26 and a locking engaging piece 28 are formed which protrude radially outwardly. The turning engaging piece 26 (constituting engaging means) and the locking engaging piece 28 are arranged at symmetrical positions with respect to the axis center of the main member 8. The diameters of the flanges 22 and 24 are formed to be the same, except for the sites of formation of the turning engaging piece 26 and the locking engaging piece 28. The protruding length of the turning engaging piece 26 from the flange 24 is larger than the length of the locking engaging piece 28. On one side of the locking engaging piece 28 in the peripheral direction in the flange 24, a notch 29 where the flange 24 does not exist is formed.

On the inner peripheral surface of the second cylindrical portion 14, four engaging concaves 14*a* are formed with equal spacings in the peripheral direction. Each of the engaging concaves 14*a* is rectangular when viewed from the axis center. In the lower end part of the plastic container 4 which accommodates the toner, a discharge opening (not shown) is formed. On the outer peripheral surface of this discharge opening, engaging convexes corresponding to the engaging concaves 14*a* are formed. By force fitting the respective engaging convexes into the corresponding engaging concaves 14*a*, the container 4 can be mounted integrally on the main member 8. When the container 4 has been mounted on the main member 8, the lower end of the discharge opening of the container 4 is brought into contact with the seal member to prevent toner leakage.

On the outer peripheral surface of the second cylindrical portion 14, a pair of engaged concaves (undercuts) 14*b* are formed. The respective engaged concaves 14*b* are arranged at symmetric positions with respect to the axis center of the main member 8, and are formed so as to extend along the peripheral direction with a constant axial width and a constant axial depth over a predetermined angular range. This angle is 90° or more.

Figure 11:
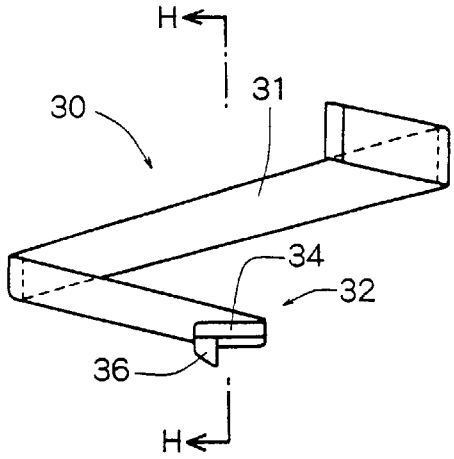
FIG. 11 is a front view of a locking member.
Figure 12:
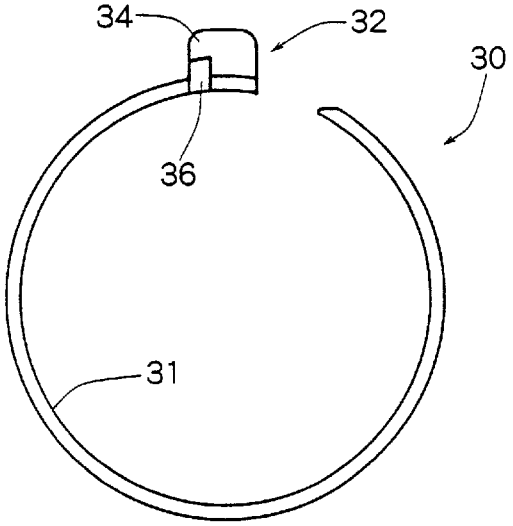
FIG. 12 is a view of FIG. 11 as viewed from below.
Figure 13:
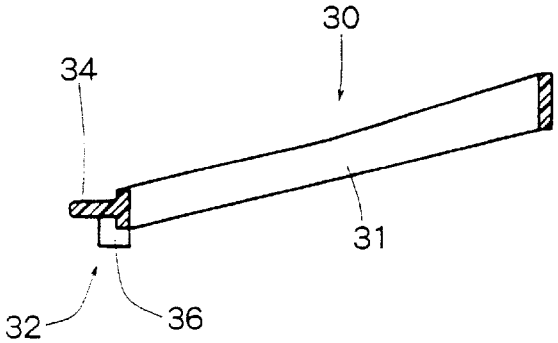
FIG. 13 is a sectional view taken on line H—H of FIG. 11.
Figure 14:
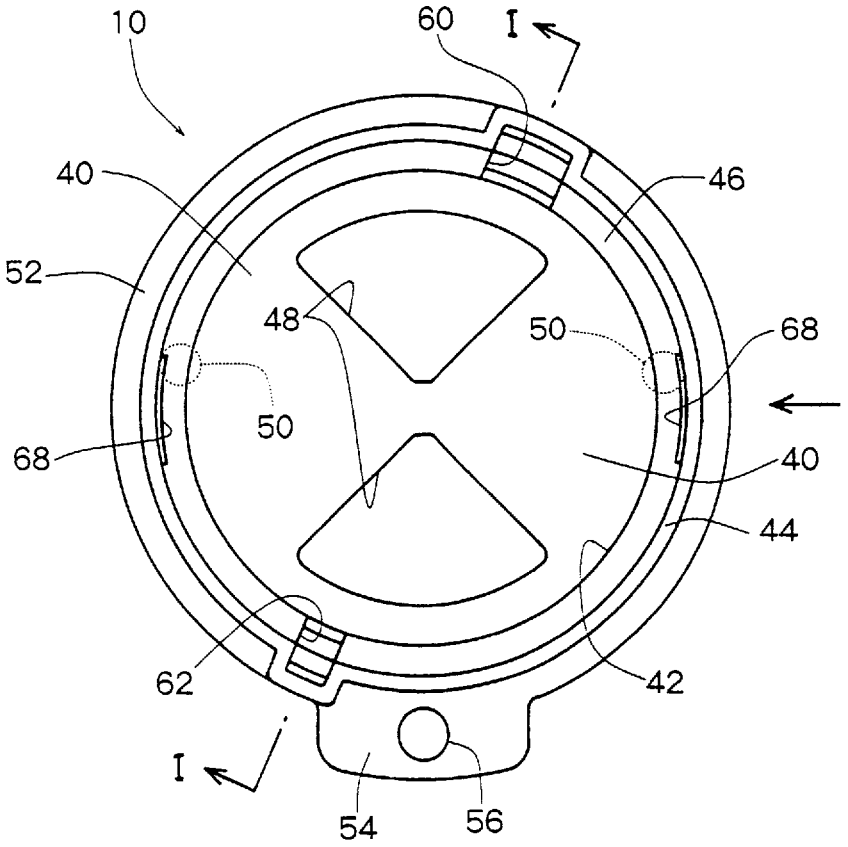
FIG. 14 is a plan view of a container shutter member.
Figure 15:
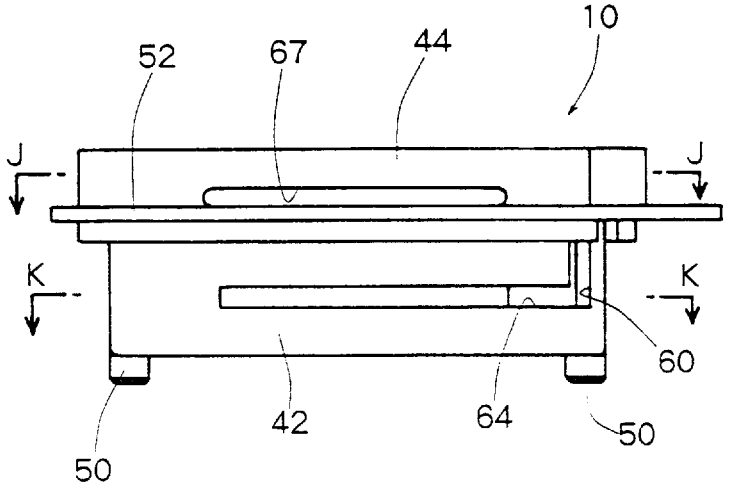
FIG. 15 is a side view of FIG. 14 as viewed from right.
Figure 16:
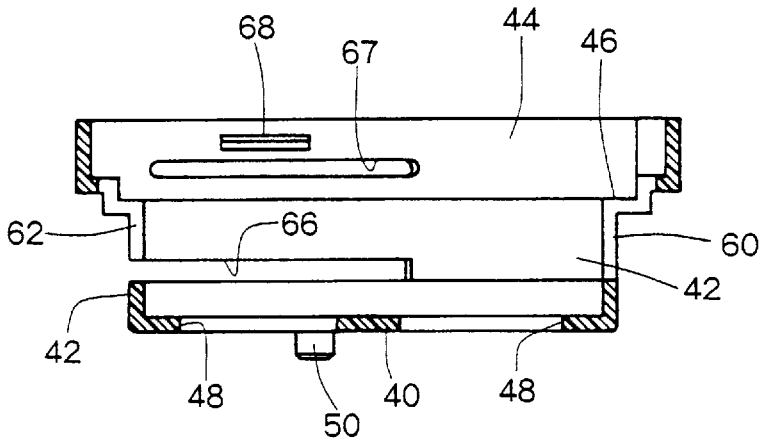
FIG. 16 is a sectional view taken on line I—I of FIG. 14.
Figure 17:
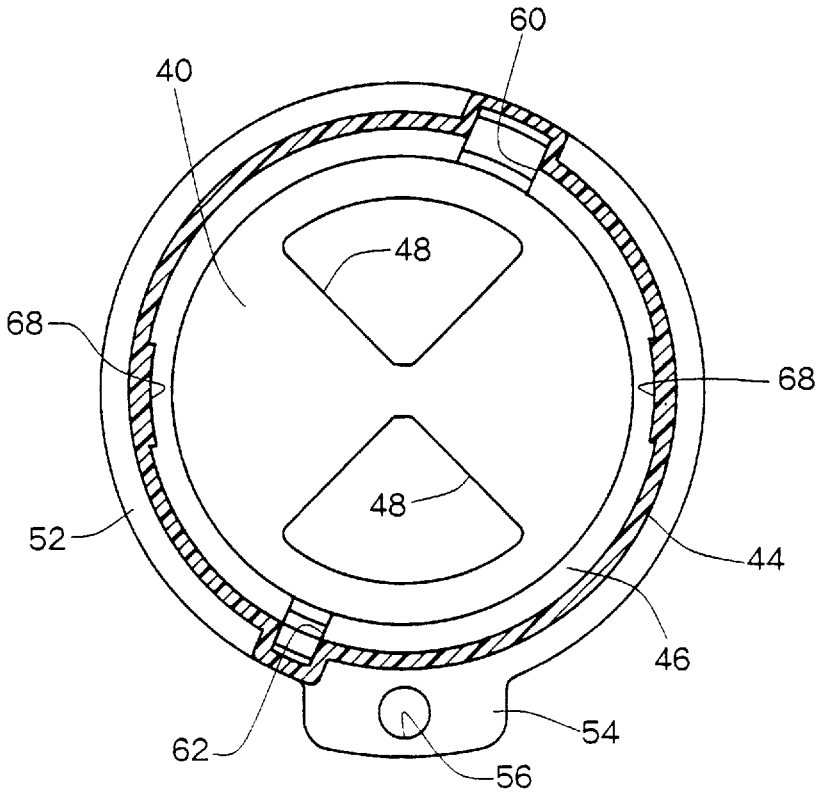
FIG. 17 is a sectional view taken on line J—J of FIG. 15.
Figure 18:
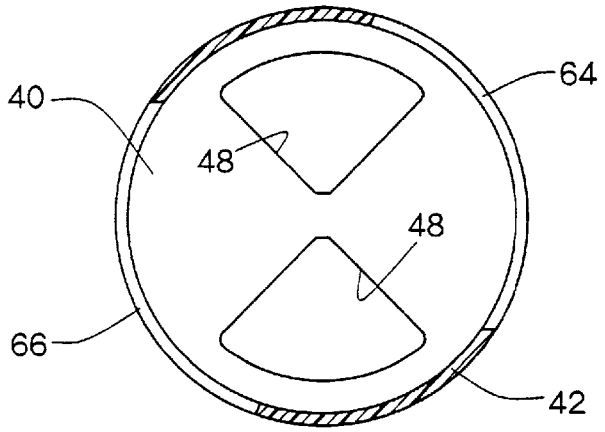
FIG. 18 is a sectional view taken on line K—K of FIG. 15.
Figure 19:
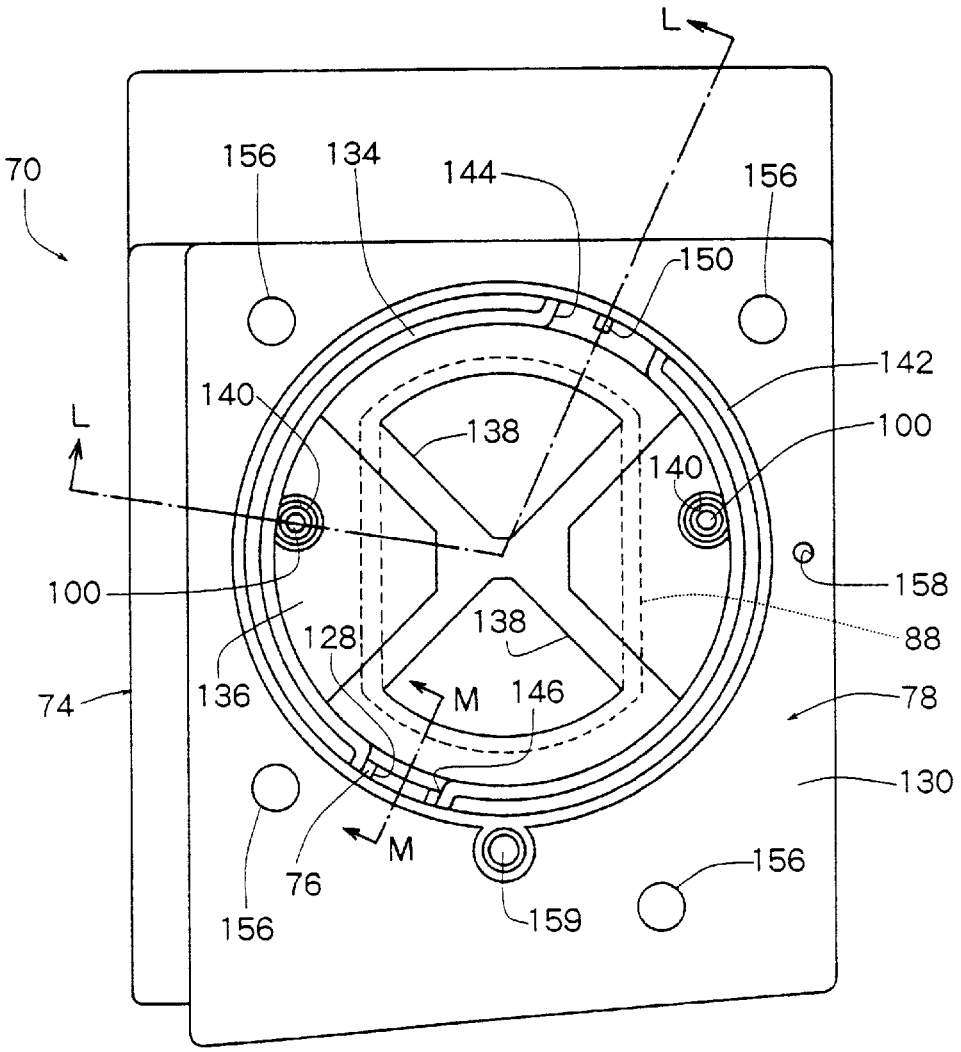
FIG. 19 is a plan view of a mounting base.
Figure 20:
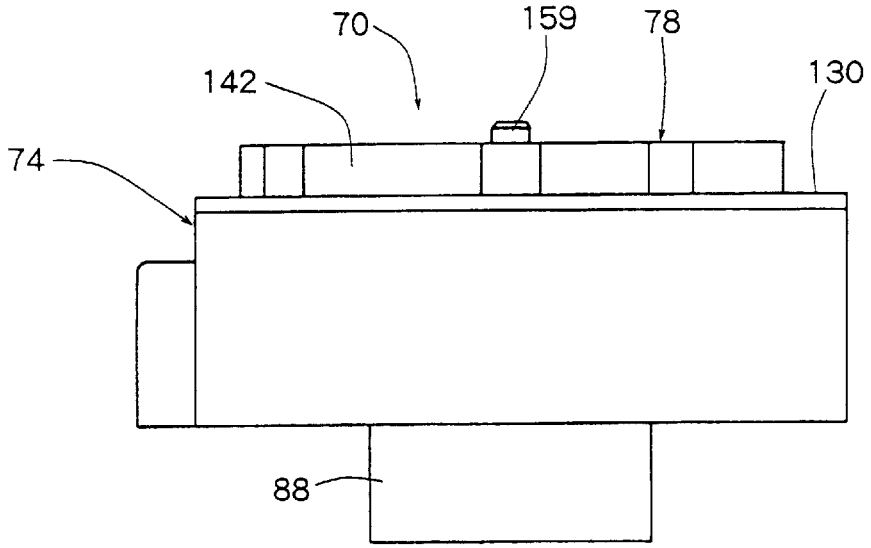
FIG. 20 is a front view of FIG. 19 as viewed from below.

With reference to FIGS. 11 to 13 as well, a locking member 30 is mounted removably between the upper surface of the flange 24 and the lower surface of the annular stepped portion 16 on the outer peripheral surface of the first cylindrical portion 12. The locking member 30, which may be integrally molded from a plastic material with elasticity, such as ABS resin or PS resin, has a body portion 31 comprising an annular plate member having a predetermined width and a predetermined thickness and also having two ends. The body portion 31, which can be regarded as a relatively narrow, thin band-like member, is substantially circular when viewed in the axial direction, and is shaped like a spiral both ends of which are spaced from each other in the axial direction when viewed in the radial direction. The inner diameter of the circular part of the body portion 31 is set to be nearly equal to the outer diameter of the first cylindrical portion 12. The locking member 30 is very easy to elastically deform in a circular form with its opposite ends substantially facing each other in the peripheral direction, by moving the opposite ends in the axial direction. Once the compelling force involved is removed, the locking member 30 returns to its original spiral shape. When the locking member 30 is rendered circular by elastic deformation, a predetermined spacing is provided between one end of it and the other end, and a locking portion 32 is formed at the one end. The locking portion 32 has a locking flange portion 34 extending radially outwardly, and a locking claw portion 36 extending axially from the locking flange portion 34 and away from the other end of the locking member 30.

The locking flange portion 34 is in a nearly rectangular shape when viewed in the axial direction. The locking claw portion 36 is a peripheral end part of the locking flange portion 34 (the end part farther in the peripheral direction with respect to the other end of the locking member 30), and is formed so as to spread from the body portion 31 of the locking member 30 to the locking flange portion 34. The peripheral width of the locking claw portion 36 is smaller than that of the locking flange portion 34, while its radially outwardly protruding length from the body portion 31 is smaller than that of the locking flange portion 34. The width of the body portion 31 of the locking member 30 is smaller than the spacing between the upper surface of the flange 24 and the lower surface of the annular stepped portion 16. The width of the other end of the body portion 31 where the locking flange portion 34 is formed is smaller than the width of the one end of the body portion 31. This is intended to provide between the upper surface of the flange 24 and the lower surface of the annular stepped portion 16 such a spacing that the locking flange portion 34 can move axially between a locking position and a locking release position as will be described later on.

The so constituted locking member 30 is mounted in a substantially tightly contacted state, with its elasticity utilized, on the outer peripheral surface of the first cylindrical portion 12, between the upper surface of the flange 24 and the lower surface of the annular stepped portion 16 (substantially functioning as a flange). The so mounted locking member 30 has its opposite ends forcibly moved by the axial spacing between the upper surface of the flange 24 and the annular stepped portion 16, whereby the locking member 30 is elastically deformed in a circular shape with its opposite ends facing each other in substantially the peripheral direction. The locking claw portion 36 is engaged with the notch 29 of the flange 24 (to define the locking position). This is because the locking member 30 originally has a spiral shape, and so its opposite ends try to leave in the axial direction by the action of an elastic restoring force. On the outer peripheral surface of the first cylindrical portion 12, an annular concave is defined by the upper surface of the flange 24 and the lower surface of the annular stepped portion 16, and it can be said that the locking member 30 is mounted on this annular concave. As regards this mounting of the locking member 30, the annular stepped portion 16 has a substantially comparable function to that of the flange 24, namely, the function of elastically deforming the locking member 30 in the axial direction as described above, thereby imparting an axial spring force. It can be said, therefore, that the annular concave is defined by the outer peripheral surface of the first cylindrical portion 12 and the two flanges. In this mounted state, the body portion 31 is set to have such a thickness as not to protrude from the outer peripheral surface of the flange 24; the radial front end of the locking claw portion 36 is set at such a size as not to protrude from the radial front end of the locking engaging piece 28; and the radial front end of the locking flange portion 34 is set at such a size as to protrude radially outwardly of the locking engaging piece 28 by a predetermined length.

Next, the container shutter member 10 will be described. Referring to FIGS. 14 to 18, the container shutter member 10 which can be integrally molded from a plastic material such as ABS resin or PS resin is shaped like a cap as a whole. The container shutter member 10 has a substantially flat bottom wall 40 having a circular peripheral edge, a first cylindrical portion 42 extending vertically upwardly from the peripheral edge of the bottom wall 40, and a second cylindrical portion 44 formed in an upper end part of the first cylindrical portion 42. The second cylindrical portion 44 has a larger diameter than the diameter of the first cylindrical portion 42, so that a horizontal annular stepped portion 46 is formed between the first cylindrical portion 42 and the second cylindrical portion 44. In the bottom wall 40, a pair of passage openings 48 are formed. The respective passage openings 48 are arranged at symmetrical positions with respect to the axis center of the container shutter member 10, and each assume a substantially 90°-fan shape. On the upper surface of the bottom wall 40 excluding the respective passage openings 48, a seal member (not shown) is disposed.

Near a peripheral edge part of the lower surface of the bottom wall 40, a pair of locking release pins 50 constituting locking release means are formed so as to protrude in the axial direction. The respective locking release pins 50 are located at symmetrical positions with respect to a straight line passing through the axis center. Close to the lower end of the second cylindrical portion 44, a substantially annular flange 52 is formed which extends radially outwardly. In a part of the flange 52, an overhang portion 54 is formed which sticks out further radially compared with other parts. In this overhang portion 54, a positioning hole 56 is formed to constitute rotation inhibited means.

In the second cylindrical portion 44 and the first cylindrical portion 42, a first notch 60 and a second notch 62 are formed. The first notch 60 and the second notch 62 are arranged at symmetrical positions with respect to the axis center of the container shutter member 10. These notches 60 and 62 each extend axially from the upper end of the second cylindrical portion 44 to a site near the lower end of the first cylindrical portion 42, and assume a substantially rectangular shape when viewed from the axis center. The peripheral width of the first notch 60 is larger than that of the second notch 62. In the first cylindrical portion 42, a pair of slits 64 and 66 are formed. The slits 64 and 66 are arranged at symmetrical positions with respect to the axis center of the container shutter member 10, and are each formed so as to extend in the peripheral direction with a constant axial width. One end, in the peripheral direction, of the slit 64 communicates with the lower end of the first notch 60, and the other end of the slit 64 is located at a peripheral position about 90° from the one end (i.e., a clockwise position in FIG. 14). One end, in the peripheral direction, of the slit 66 communicates with the lower end of the second notch 62, and the other end of the slit 66 is located at a peripheral position about 90° from the one end (i.e., a clockwise position in FIG. 14).

Near the lower end in the axial direction of the second cylindrical portion 44, a pair of other slits 67 are formed. The respective slits 67 are arranged at symmetrical positions with respect to the axis center of the container shutter member 10, and are each formed so as to extend over a predetermined angular range in the peripheral direction. On the inner peripheral surface of the second cylindrical portion 44 and above the respective other slits 67 in the axial direction, engaging convexes 68 are formed. The engaging convexes 68 are each formed so as to extend over a predetermined angular range with a constant axial width and a constant radially inwardly protruding thickness. This angle is set to be in a narrower range than that of the corresponding other slits 67.

The peripheral width of the locking flange portion 34 of the locking member 30 mounted on the main member 8 is smaller than that of the first notch 60 of the container shutter member 10. The locking flange portion 34 is adapted to be axially movable with respect to the first notch 60, but to be substantially immovable in the peripheral direction because of its relative interference with the first notch 60. The radial front position of the locking flange portion 34 goes beyond an outer peripheral part of the first cylindrical portion 42 of the container shutter member 10. The peripheral width of the turning engaging piece 26 of the main member 8 is smaller than that of the second notch 62 of the container shutter member 10. The diameters of the flanges 22 and 24 formed on the first cylindrical portion 12 of the main member 8 are smaller than the internal diameter of the first cylindrical portion 42 of the container shutter member 10. The diameter of the outer peripheral surface of the second cylindrical portion 14 of the main member 8 is slightly larger at the axial lower end than the internal diameter of the second cylindrical portion 44 of the container shutter member 10, and slightly larger at the axial upper part than the internal diameter of the second cylindrical portion 44.

Mounting of the main member 8 and the container shutter member 10 to each other is performed in the following manner: Reference is made mainly to FIGS. 1 to 5. The locking flange portion 34 on the main member 8 having the locking member 30 mounted thereon is aligned with the first notch 60 of the container shutter member 10. Also, the turning engaging piece 26 of the main member 8 is engaged with the second notch 62 of the container shutter member 10. With these alignments being kept, the main member 8 and the container shutter member 10 are forcibly moved in the axial direction toward each other. The respective engaging convexes 68 formed on the inner peripheral surface of the second cylindrical portion 44 of the container shutter member 10 are thereby fitted into the corresponding engaged concaves 14*b* formed on the outer peripheral surface of the second cylindrical portion 14 of the main member 8. As a result, the container shutter member 10 and the main member 8 are coupled together so as to be rotatable relative to each other and immovable axially, with the inner peripheral surface of the second cylindrical portion 44 of the container shutter member 10 being force fitted onto the outer peripheral surface of the second cylindrical portion 14 of the main member 8. Each of the through-holes 20 of the main member 8 is closed with the corresponding bottom wall 40 of the container shutter member 10.

The turning engaging piece 26 and locking engaging piece 28 of the main member 8 are positioned at the bottom parts of the corresponding notches 62 and 60 of the container shutter member 10, and thus are positioned at the peripheral end parts of the corresponding slits 66 and 64. The locking member 30 mounted on the main member 8 is positioned in the annular gap between the inner peripheral surface of the first cylindrical portion 42 of the container shutter member 10 and the outer peripheral surface of the first cylindrical portion 12 of the main member 8. The opposite ends in the peripheral direction of the locking flange member 34 of the locking member 30 are positioned between the peripherally opposite ends of the notch 60 of the container shutter member 10. The locking claw portion 36 is fitted into the notch 29 of the flange 24 of the main member 8 (i.e., is positioned at the locking position) by an urging force (elastic force) heading axially downwardly owing to the elasticity of the locking member 30. Hence, the movement of the locking engaging piece 28 of the main member 8 toward the slit 64 is inhibited by the locking claw portion 36 and the locking flange portion 34, so that the relative rotation of the main member 8 and the container shutter member 10 is inhibited, and both the main member 8 and the container shutter member 10 are held in the locked state. Axially above the main member 8, the container 4 accommodating the toner is mounted as stated earlier.

In the so assembled toner cartridge 2, each of the through-holes 20 is closed with the corresponding bottom wall 40 of the container shutter member 10, and the relative rotation of the main member 8 and the container shutter member 10 is reliably inhibited by the locking member 30. Thus, if any vibration or load acts except during toner replenishment, as during transportation of the toner cartridge, the through-holes 20 of the main member 8 do not open, and the unexpected discharge of the toner is prevented reliably. Thus, neither the contamination of the surroundings with the toner nor a waste of the toner takes place.

When the locking flange portion 34 of the locking member 30 is forced, against urging due to its elasticity, to leave the locking engaging piece 28 of the main member 8 axially and upwardly, the locking flange portion 34 is moved upwards along the notch 60 of the container shutter member 10. Thus, the locking claw portion 36 is removed upwardly from the notch 29 of the flange 24 of the main member 8 (is moved to the locking release position). As a result, locking by the locking member 30 is released, whereby movement along the slit 64 of the locking engaging piece 28 of the main member 8 becomes possible, and the relative rotation of the main member 8 and the container shutter member 10 also becomes possible. When these two parts are relatively rotated about 90°, the locking engaging piece 28 of the main member 8 relatively moves along the slit 64, while the turning engaging piece 26 relatively moves along the slit 66. Each of the through-holes 20 of the main member 8 aligns with the corresponding passage opening 48 of the container shutter member 10, whereupon the toner in the container 4 can be discharged from the toner cartridge 2 through the discharge opening of the container 4, the through-holes 20 and the passage openings 48. That is, the container shutter member 10 is turnable relative to the main member 8 between the closed position at which it closes the through-holes 20 and the open position at which it opens the through-holes 20.

FIGS. 19 to 22 show a mounting base 70 on which the toner cartridge 2 is mounted removably. The mounting base 70 includes a body 74 mounted on the hopper of the developing device (not shown) and having toner replenishment openings 72 (to be described later on) for replenishing a toner, a replenishment opening shutter member 76 removably mounted on the body 74, and a receiving base 78 removably mounted on the body 74 so as to cover the replenishment opening shutter member 76 from above.

Referring to FIGS. 23 to 26, the body 74, which can be integrally molded from a plastic material such as ABS resin or PS resin, has a top wall 80 nearly rectangular when viewed from above and extending horizontally, and a disc-shaped concave 82 extending from the top wall 80 vertically downwardly. The concave 82 has a cylindrical portion 84, a bottom wall 86 positioned at the lower end of the cylindrical portion 84 and extending horizontally, and a tubular portion 88 extending from the bottom wall 86 vertically downwardly. In the bottom wall 86, a pair of toner replenishment openings 72 are formed. Each toner replenishment openings 72 is arranged at symmetrical positions with respect to the axis center of the concave 82, and each assume a substantially 90°-fan shape when viewed in the axial direction. The respective toner replenishment openings 72 communicate with the tubular portion 88. In the bottom wall 86, a pair of concaves 90 are formed which extend vertically downwardly from the bottom wall 86 and whose lower ends are closed with bottom walls. The respective concaves 90 are provided to place therein a locking member 100 (to be described later on). These concaves 90 are close to a peripheral edge part of the bottom wall 86, and they are arranged at symmetrical positions with respect to a straight line passing through the axis center of the concave 82. In the bottom wall 86, a through-hole 92 is formed at its axis center.

In the cylindrical portion 84 of the concave 82, a first notch 94 and a second notch 96 are formed. The first notch 94 and the second notch 96 are arranged at symmetrical positions with respect to the axis center of the concave 82. These notches 94 and 96 each extend axially from the upper end of the cylindrical portion 84 (including part of the top wall 80) toward the bottom wall 86 with a predetermined peripheral width, and assume a substantially rectangular shape when viewed from the axis center. The lower end of each of the notches 94 and 96 is located nearly in the middle in the axial direction of the cylindrical portion 84. The peripheral width of the first notch 94 is larger than that of the second notch 96. In or on the top wall 80, four mounting holes 97 and two positioning pins 98 and 99 extending vertically upwardly are formed.

Figure 21:
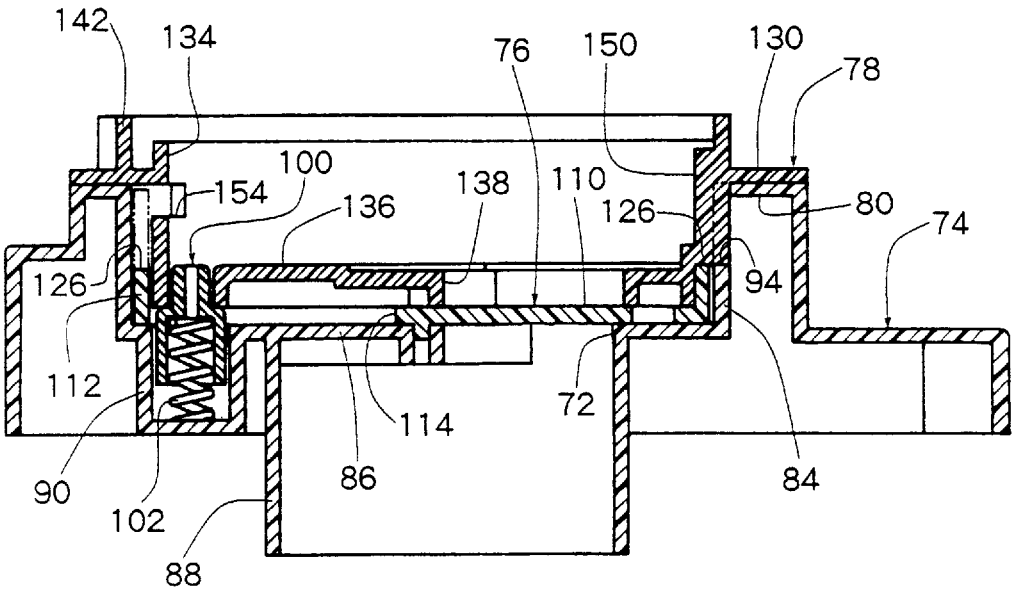
FIG. 21 is a sectional view taken on line L—L of FIG. 19.

With reference to FIG. 21 as well, a locking member (locking pin member) 100 constituting locking means and a spring member 102 are inserted in each of the concaves 90. The locking member 100 is composed of a pin-shaped member having a major diameter portion and a minor diameter portion, and the major diameter portion is in a cylindrical form. Each of the locking members 100 is inserted into the concave 90 axially movably, and is supported by the spring member 102. The minor diameter portion and part of the major diameter portion are positioned so as to protrude upwardly from the concave 90.

The so constituted body 74 is mounted on the upper end of the hopper disposed in the developing device of the image forming machine (none of these devices are shown). In the upper end of the hopper, an acceptance opening is formed, and the tubular portion is inserted into the acceptance opening via a seal member (not shown). Thus, the body 74 can be said to constitute part of the hopper.

FIGS. 27 to 30 show a replenishment opening shutter member 76. The replenishment opening shutter member 76 which can be integrally molded from a plastic material such as ABS resin or PS resin comprises a bottom wall 110 extending horizontally and having a circular peripheral edge, and a circular wall portion 112 extending vertically upwardly from the peripheral edge of the bottom wall 110. In the bottom wall 110, a pair of passage openings 114 are formed. The respective passage openings 114 are arranged at symmetrical positions with respect to the axis center of the replenishment opening shutter member 76, and each assume a substantially 90°-fan shape when viewed in the axial direction. Each of the passage openings 114 is formed so that an arcuate band portion 116 (gap) will be left between each arcuate part of the passage opening 114 and the peripheral edge of the bottom wall 110. In each of these band portions 116 in the bottom wall 110, an arcuate notch 118 is formed. The respective notches 118 are located at symmetrical positions with respect to a straight line passing through the axis center, and the radius of the notch 118 is slightly larger than the major diameter portion of the locking member 100. In the bottom wall 110, a pair of arcuate slits 120 are formed. Each of the slits 120 extends counterclockwise in FIG. 27 with a predetermined width from the linear end of the corresponding passage opening 114. One end 122 of the slit 120 is located at a position about 90° in the peripheral direction from the notch 118 of the corresponding passage opening 114. Between each slit 120 and the peripheral edge of the bottom wall 110, too, the arcuate band portion 116 is left. The width of each slit 120 is slightly larger than the minor diameter portion of the locking member 100. The radially outward peripheral surface of the slit 120 is positioned on a continuous peripheral surface having an axis center substantially common to the peripheral surface of the arcuate portion of each passage opening 114. At the axis center of the bottom wall 110, a pin portion 124 is formed which extrudes vertically downwardly.

In the circular wall portion 112, a first notch 126 and a second notch 128 are formed which each extend vertically downwardly from the upper end with a predetermined peripheral width. The depth in the axial direction of the first notch 126 is greater than that of the second notch 128, while the width in the peripheral direction of the first notch 126 is greater than that of the second notch 128. One end in the peripheral direction of the first notch 126 (the left end in FIG. 27) is present at nearly the same position as one of the arcuate notches 118 (the left one in FIG. 27), while the other end of the first notch 126 (the right end in FIG. 27) is located at a position nearly symmetrical to the second notch 128 with respect to the axis center. The second notch 128 constitutes engaged means.

Figure 22:
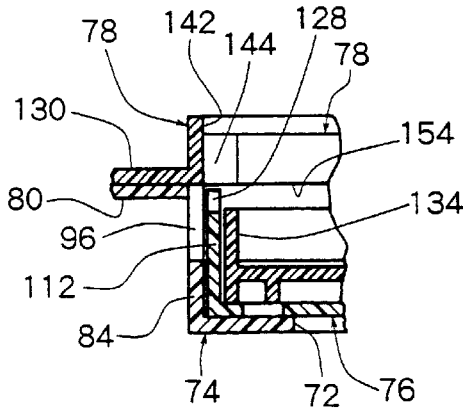
FIG. 22 is a sectional view taken on line M—M of FIG. 19.
Figure 23:
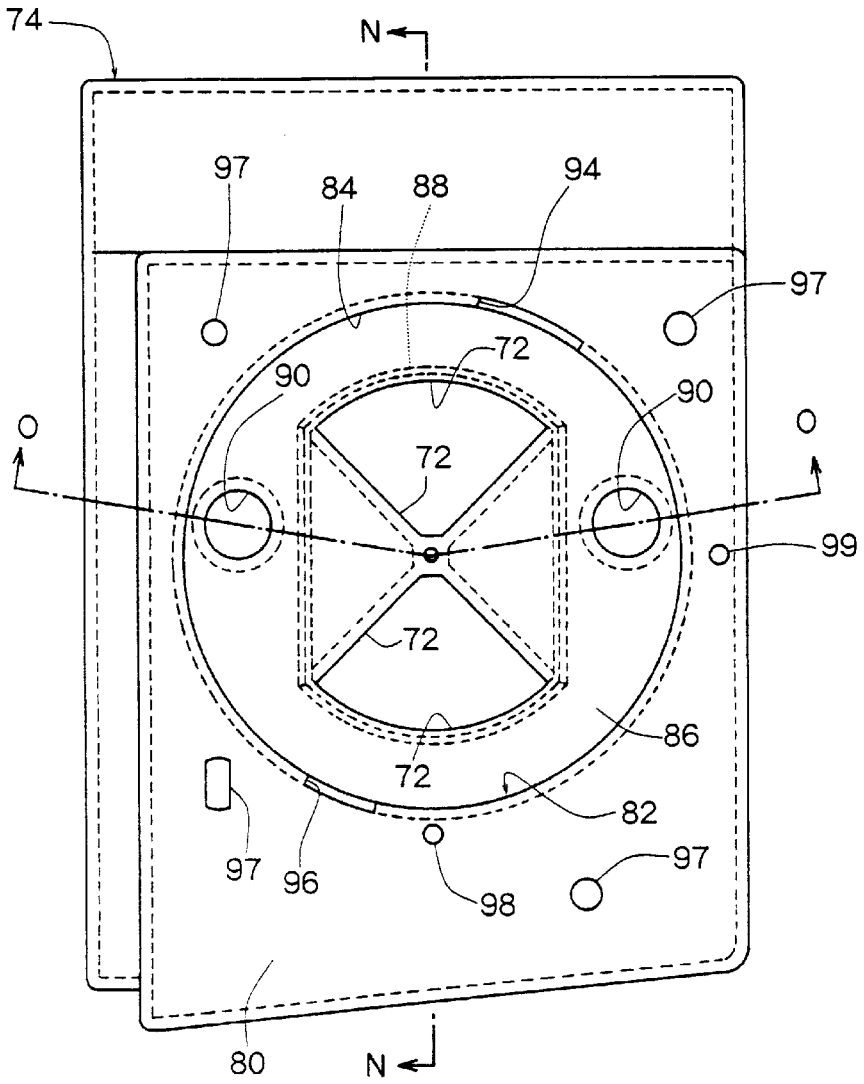
FIG. 23 is a plan view of the body of the mounting base.
Figure 24:
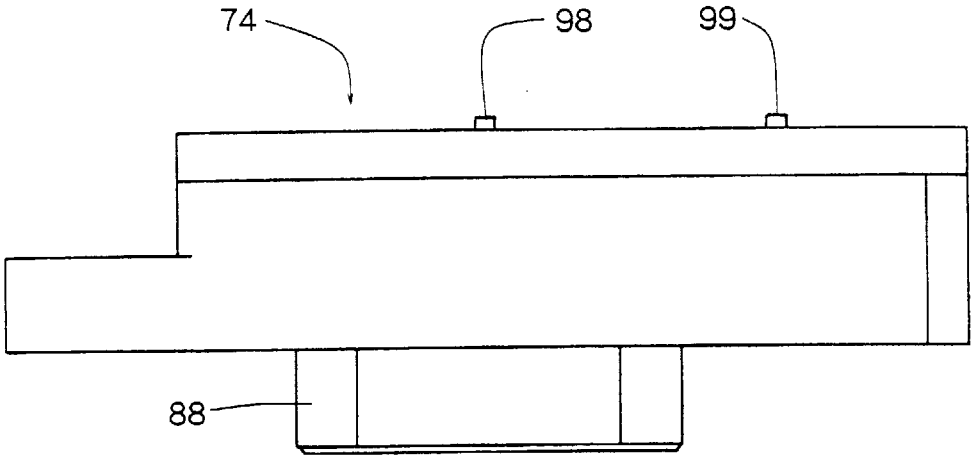
FIG. 24 is a side view of FIG. 23 as viewed from left.
Figure 25:
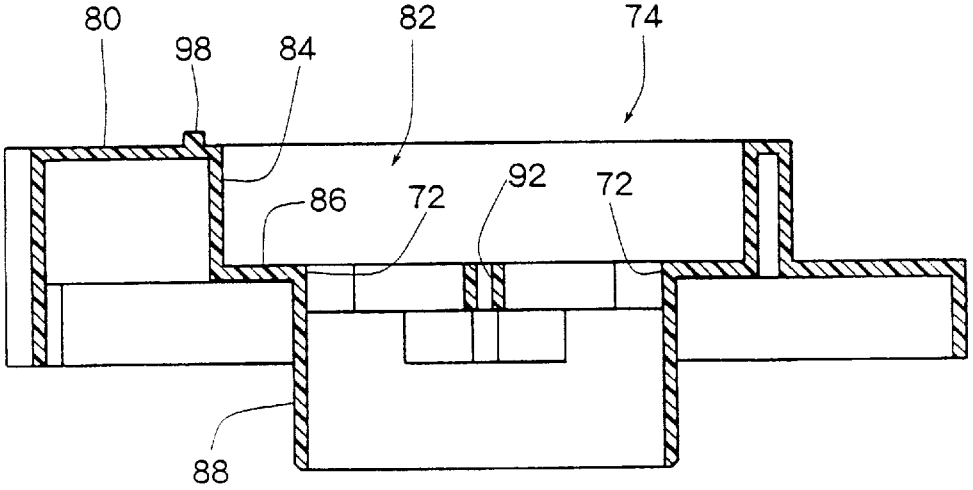
FIG. 25 is a sectional view taken on line N—N of FIG. 23.
Figure 26:
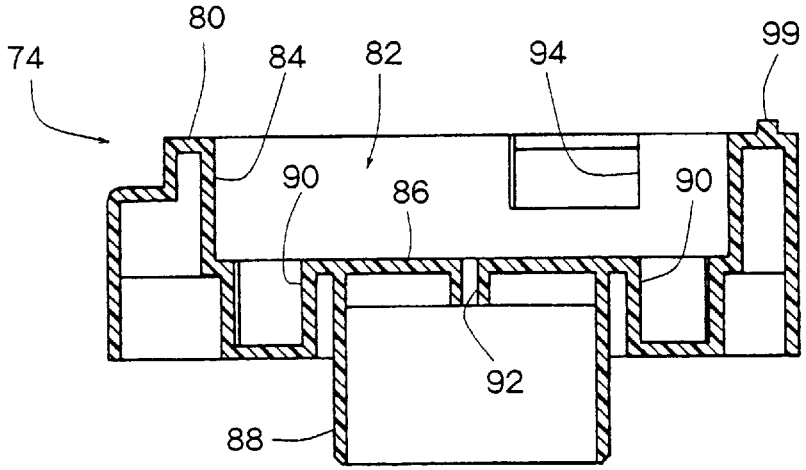
FIG. 26 is a sectional view taken on line O—O of FIG. 23.
Figure 27:
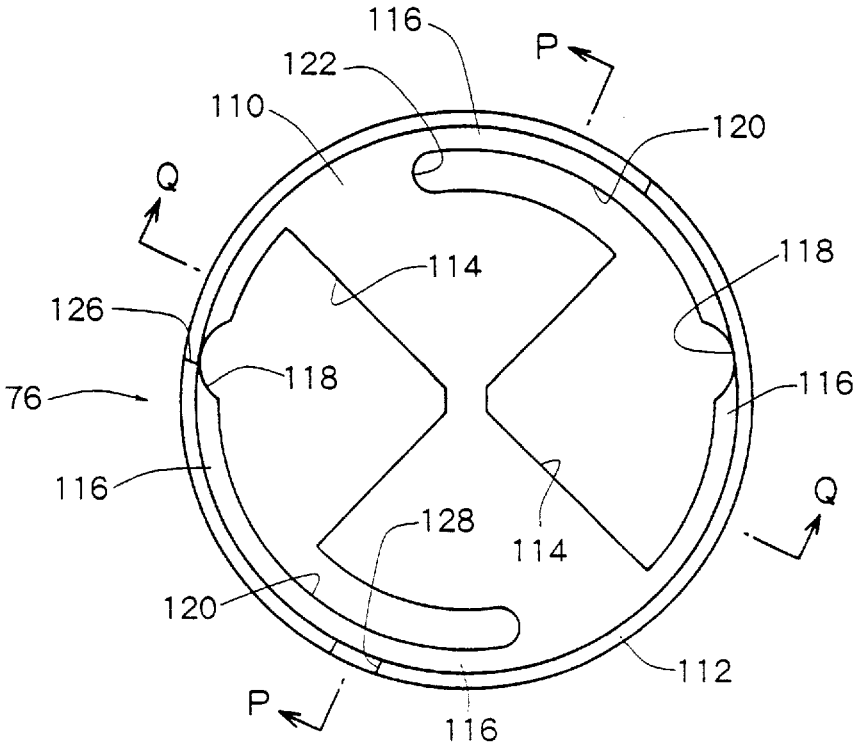
FIG. 27 is a plan view of a replenishment opening shutter member.
Figure 28:
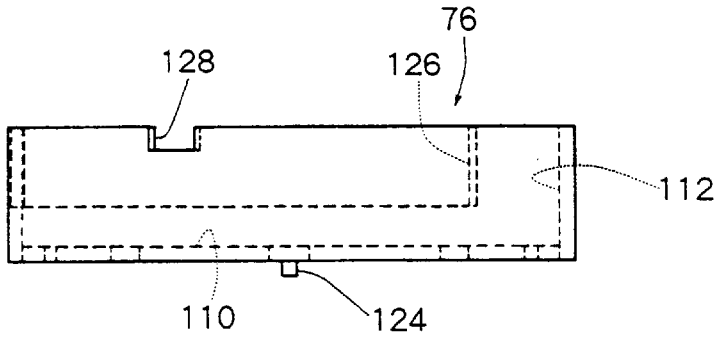
FIG. 28 is a front view of FIG. 27 as viewed from below.
Figure 29:
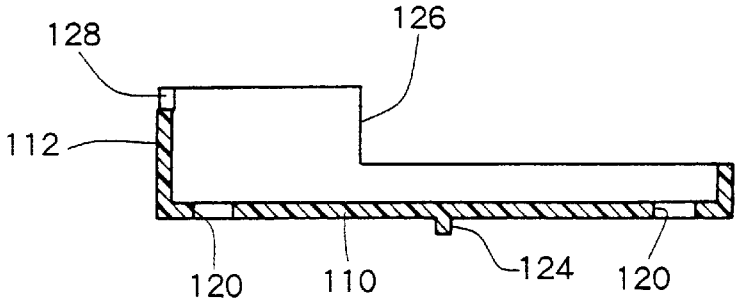
FIG. 29 is a sectional view taken on line P—P of FIG. 27.
Figure 30:
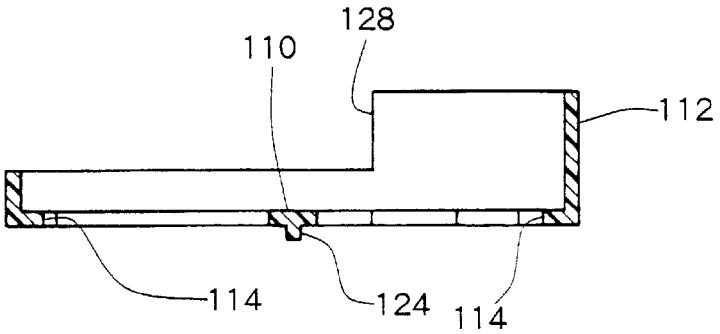
FIG. 30 is a sectional view taken on line Q—Q of FIG. 27.
Figure 31:
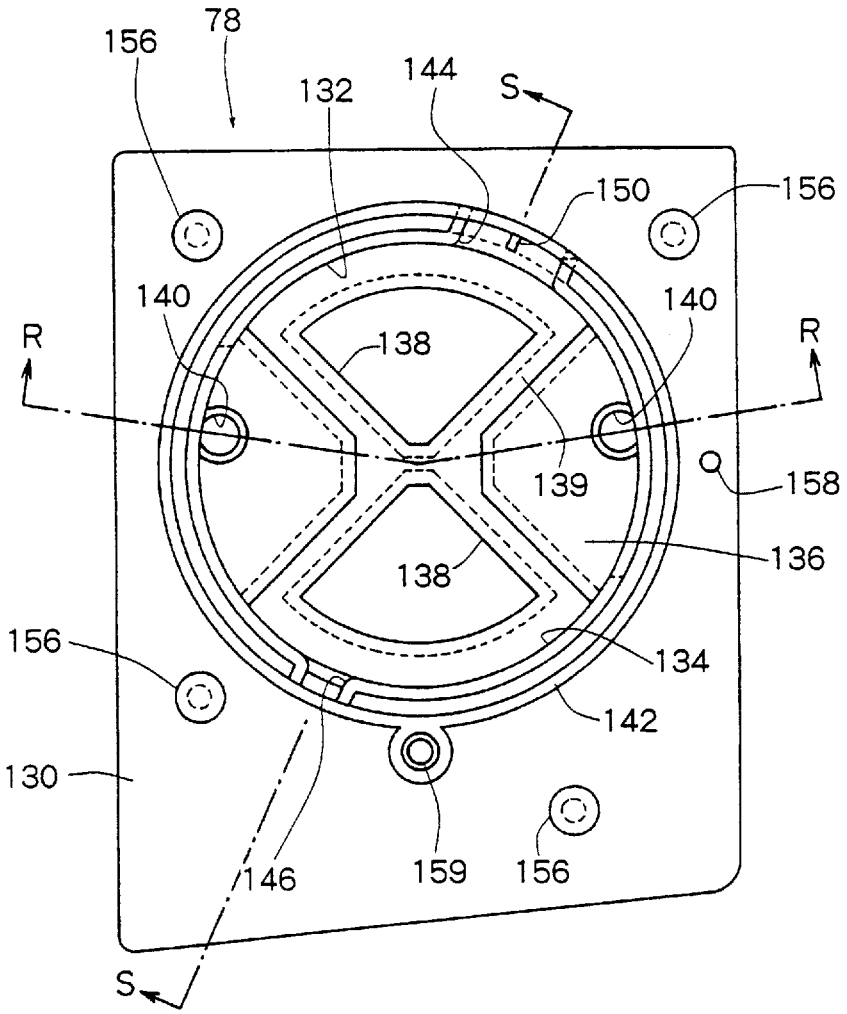
FIG. 31 is a plan view of a receiving base.
Figure 32:
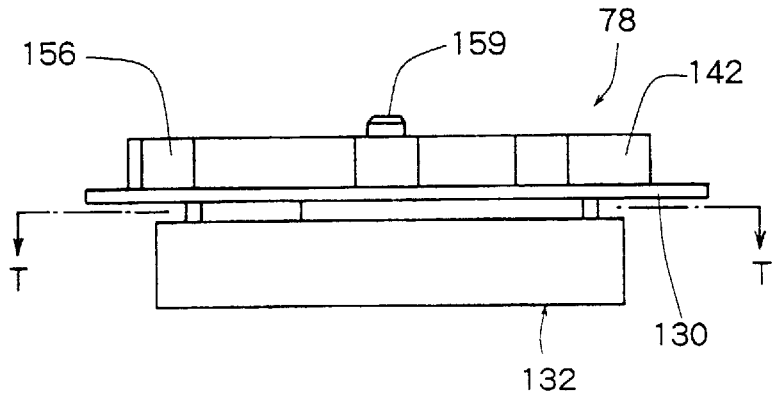
FIG. 32 is a front view of FIG. 31 as viewed from below.
Figure 33:
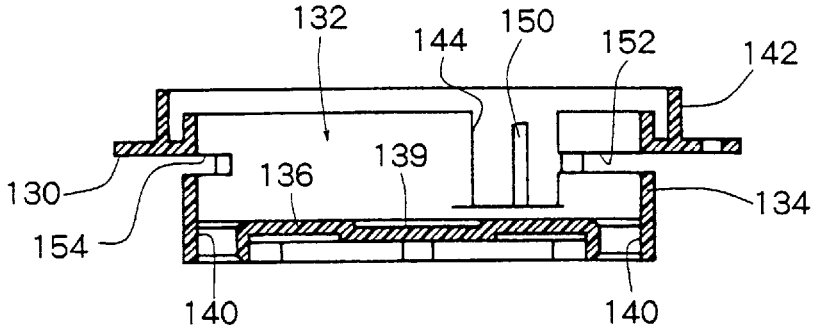
FIG. 33 is a sectional view taken on line R—R of FIG. 31.
Figure 34:
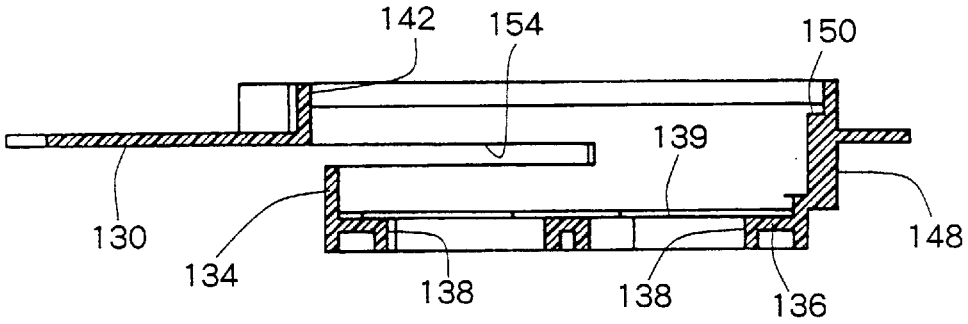
FIG. 34 is a sectional view taken on line S—S of FIG. 31.
Figure 35:
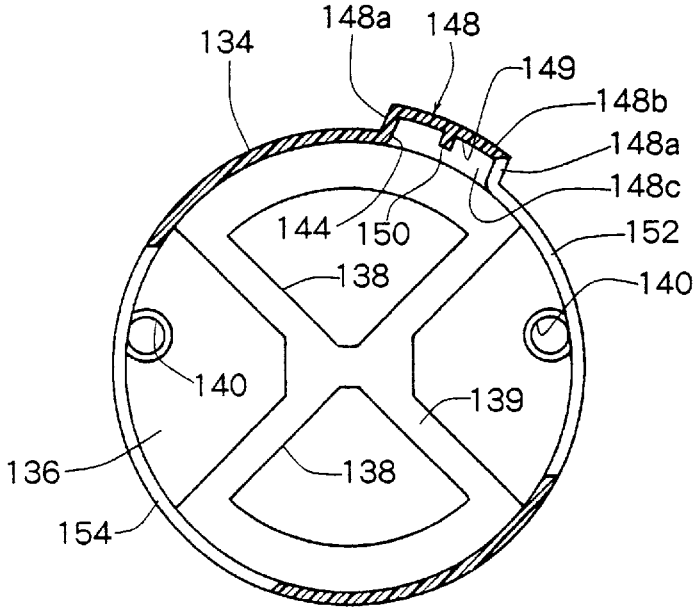
FIG. 35 is a sectional view taken on line T—T of FIG. 32.
Figure 36:
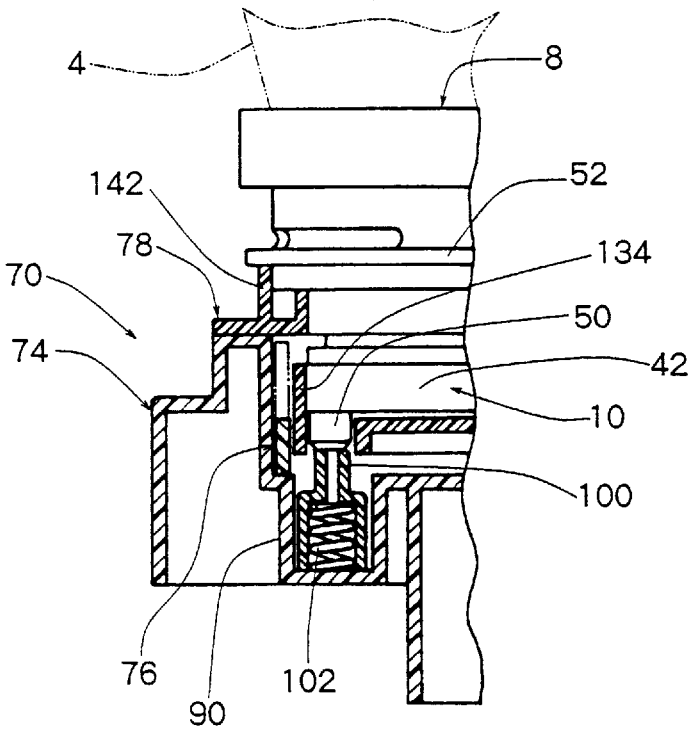
FIG. 36 is a partial sectional view showing a state in which the toner cartridge is mounted on the mounting base, as a view corresponding to a site leftward of the center line of FIG. 21.
Figure 37:
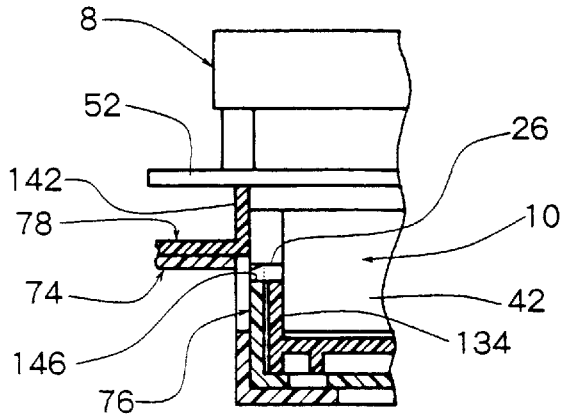
FIG. 37 is a partial sectional view showing a state in which the toner cartridge is mounted on the mounting base, as a view corresponding to FIG. 22.
Figure 38:
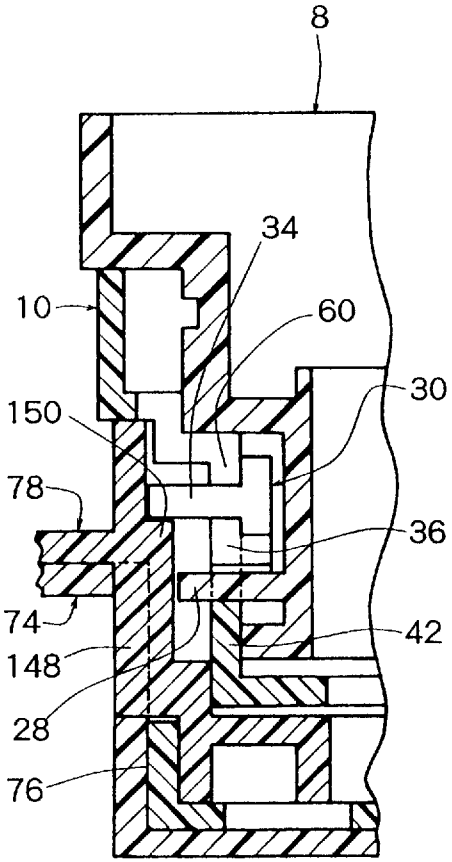
FIG. 38 is a partial sectional view showing a state in which the toner cartridge is mounted on the mounting base, as a view corresponding to a site rightward of the center line of FIG. 21.
Figure 39:
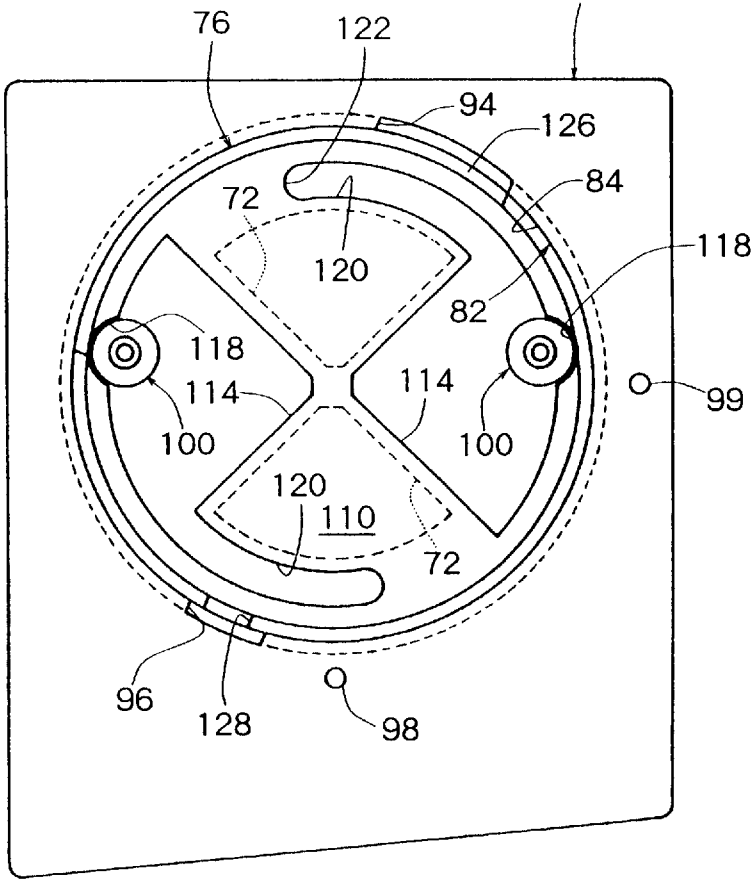
FIG. 39 is a plan view, partially omitted, of the replenishment opening shutter member mounted on the body of the mounting base.

With reference to FIGS. 21 and 22 as well as 39, the so constituted replenishment opening shutter member 76 is removably and turnably inserted into the concave 82 of the body 74 in the mounting base 70. In this state of mounting, the pin portion 124 of the replenishment opening shutter member 76 is fitted turnably into the through-hole 92 of the body 74, while the arcuate notches 118 of the replenishment opening shutter member 76 are releasably fitted over the outer peripheral surfaces of the major diameter portions of the corresponding locking members 100 protruding upwards from the bottom wall 86 of the concave 82. The turn of the replenishment opening shutter member 76 relative to the concave 82 is inhibited by the fitting of the notches 118 over the major diameter portions of the corresponding locking members 100. As a result of this locked state, the replenishment opening shutter member 76 keeps its closed position. The toner replenishment openings 72 of the bottom wall 86 of the concave 82 are closed by the bottom wall 110 of the replenishment opening shutter member 76. The second notch 128 of the replenishment opening shutter member 76 aligns with the second notch 96 of the concave 82, while the other end of the first notch 126 of the replenishment opening shutter member 76 aligns with one end of the first notch 94 of the concave 82 (the right end in FIG. 23). That is, an upstream end (the right end in FIG. 27), in the opening direction (the clockwise direction in FIG. 39) of the replenishment opening shutter member 76, of the first notch 126 of the replenishment opening shutter member 76 aligns with one upstream end (the right end in FIG. 23) in the opening direction of the first notch 94 of the body 74. Also, the other end on the downstream side (the left end in FIG. 27) of the first notch 126 of the replenishment opening shutter member 76 is located at a peripheral position between the other end on the downstream side (the left end in FIG. 23) in the opening direction of the first notch 94 of the body 74 and the second notch 96 of the body 74. Furthermore, the lower end in the axial direction of the first notch 126 of the replenishment opening shutter member 76 aligns with the lower end of the first notch 94 of the concave 82. As described above, the positional relationship between the replenishment opening shutter member 76 and the concave 82 of the body 74 is defined. The uppermost end of the circular wall portion 112 of the replenishment opening shutter member 76 is positioned at a slightly lower level than the upper surface of the top wall 80 of the body 74. When the replenishment opening shutter member 76 is turned from the closed position (the position at which the toner replenishment opening 72 is closed completely) to the open position (the position at which the toner replenishment opening 72 is opened completely), the other end on the downstream side of the first notch 126 of the replenishment opening shutter member 76 is located at a position which does not go, in the opening direction, beyond the other end on the downstream side of the first notch 94 of the body 74.

Figure 40:
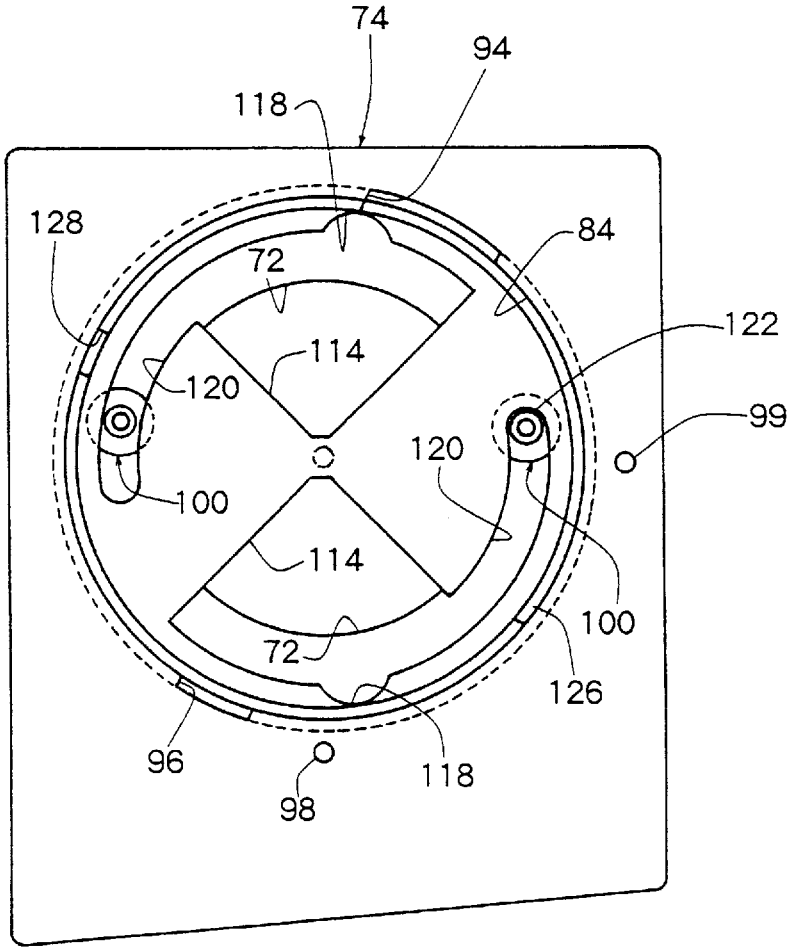
FIG. 40 is a view showing another mode of operation of FIG. 39.

As will be understood easily from the above description, the locking members 100 protruding upwards (located at the locking position) from the bottom wall 86 of the concave 82 are pushed down in the axial direction against the force of the spring member 102, thereby to release the engagement of the major diameter portions with the arcuate notches 118 of the replenishment opening shutter member 76 (i.e., to bring the locking members 100 from the locking position to the locking release position). As a result, the locking, in the turning direction, of the replenishment opening shutter member 76 relative to the concave 82 is released, whereupon the turning of the replenishment opening shutter member 76 relative to the concave 82 is allowed. At this time, only the minor diameter portions of the locking members 100 are positioned so as to protrude upward from the bottom wall 110 of the replenishment opening shutter member 76. Their interference with the replenishment opening shutter member 76 in the turning direction is avoided by the slits 120 of the replenishment opening shutter member 76 (see FIG. 40). In other words, the turning in the opening direction of the replenishment opening shutter member 76 from the closed position to the open position is permitted because the slits 120 move while accommodating the minor diameter portions of the corresponding locking pin members 100.

Referring to FIGS. 31 to 35, the receiving base body 78, which can be integrally molded from a plastic material such as ABS resin or PS resin, has a mounting plate 130 nearly rectangular when viewed from above and extending horizontally, and a disc-shaped concave 132 extending from the mounting plate 130 vertically downwardly. The concave 132 has a cylindrical portion 134, and a bottom wall 136 positioned at the lower end of the cylindrical portion 134 and extending substantially horizontally. In the bottom wall 136, a pair of passage openings 138 are formed. The passage openings 138 are arranged at symmetrical positions with respect to the axis center of the concave 132, and each assume a substantially 90°-fan shape when viewed in the axial direction. On the upper surface of the bottom wall 136 and at the peripheral edges of the passage openings 138, a low-level portion 139 is formed so as to have an upper surface parallel to the upper surface of the bottom wall 136. On the low-level portion 139, a seal member (not shown) is mounted. In the bottom wall 136, a pair of through-holes 140 are also formed. The through-holes 140 are close to the peripheral edge of the concave 132, and are arranged at symmetrical positions with respect to a straight line passing through the axis center of the concave 132. The diameter of each through-hole 140 is slightly larger than the minor diameter portion of the locking member 100 so that this minor diameter portion can be removably fitted into the through-hole 140.

An upper end part of the cylindrical portion 134 is formed so as to slightly protrude vertically upwardly from the upper surface of the mounting plate 130. On the upper surface of the mounting plate 130, an annular flange 142 is formed. The annular flange 142 is disposed so as to surround the entire periphery of the protruding upper end of the cylindrical portion 134 with a constant spacing therefrom. The upper end of the annular flange 142 is higher than the upper end of the cylindrical portion 134. The outer diameter of the cylindrical portion 134 is slightly smaller than the inner diameter of the cylindrical portion 112 of the replenishment opening shutter member 76, while the inner diameter of the annular flange 142 is slightly larger than the outer diameter of the circular wall portion 112.

In the cylindrical portion 134, a first notch 144 and a second notch 146 are formed. The first notch 144 and the second notch 146 are arranged at symmetrical positions with respect to the axis center of the concave 132. The first notch 144 extends axially from the upper end of the cylindrical portion 134 toward the upper surface of the bottom wall 136 with a predetermined peripheral width, and assumes a substantially rectangular shape when viewed from the axis center. The second notch 146 extends axially from the upper end of the cylindrical portion 134 as far as a nearly middle part in the axial direction of the cylindrical portion 134 with a predetermined peripheral width, and assumes a substantially rectangular shape when viewed from the axis center. The peripheral width of the first notch 144 is larger than that of the second notch 146. Radially outwardly of the first notch 144, an engaging convex 148 extending in the same direction is formed.

The engaging convex 148 comprises side walls 148*a* extending radially outwardly from the opposite ends in the peripheral direction of the first notch 144, an arcuate wall 148*b* extending between the outer ends in the radial direction of the side walls 148*a*, and a bottom wall 148*c* extending between the lower ends of the side walls 148*a*. The engaging convex 148 assumes a substantially rectangular shape when viewed from the axis center, and its peripheral width is slightly larger than that of the first notch 144. The engaging convex 148 extends from the lower surface of the mounting plate 130 to a level slightly above the upper surface of the bottom wall 136. The outer peripheral surface of the engaging convex 148 (the outer peripheral surface of the arcuate wall 148*b*) is positioned on substantially the same plane as the outer peripheral surface of the annular flange 142. The inner peripheral surface 149 of the engaging convex 148 (the inner peripheral surface of the arcuate wall 148*b*) is positioned on substantially the same plane as the inner peripheral surface of the annular flange 142. Each of the side walls 148*a* of the engaging convex 148 is formed such that part of the cylindrical portion 134 extends radially outwardly to be connected to the arcuate wall 148*b*. In this manner, the first notch 144 and the engaging convex 148 are formed. On the inner peripheral surface 149 of the arcuate wall 148*b* of the engaging convex 148, a projection 150 is formed which extends from the inner peripheral surface 149 radially inwardly. The projection 150 is formed so as to extend, in the middle in the peripheral direction of the engaging convex 148 (arcuate wall 148*b*), from an upper site to a lower site in the axial direction. The upper end of the projection 150 is positioned at a lower level than the upper end of the cylindrical portion 134.

In the cylindrical portion 134, a first slit 152 and a second slit 154 are formed. The slits 152 and 154 are arranged at symmetrical positions with respect to the axis center, and each extend peripherally with a constant axial width. One end in the peripheral direction of the slit 152 communicates with an intermediate part in the axial direction of the first notch 144, and the other end thereof is positioned at a peripheral position about 90° or more from the one end (the clockwise position in FIGS. 31 and 35). One end in the peripheral direction of the slit 154 communicates with the lower end of the second notch 146, while the other end thereof is positioned at a peripheral position about 90° or more from the one end (the clockwise position in FIGS. 31 and 35). The outer end in the radial direction of the upper end part of the second notch 146 is defined by the inner peripheral surface of the annular flange 142. Thus, the upper end part of the cylindrical portion 134 extends radially outwardly at the site of the second notch 146, and connects with the inner peripheral surface of the annular flange 142.

In or on the mounting plate 130, four mounting screw portions 156, two positioning holes 158, and one positioning pin 159 constituting rotation inhibiting means are formed. Each of the mounting screw portions 156 is constituted by force fitting a metallic screw member from the lower surface of the mounting plate 130 into the cylindrical portion extending upwardly from the mounting plate 130. The positioning pin 159 is force fitted into a boss portion formed on the outside of the peripheral edge of the annular flange 142, and is disposed so as to protrude upwardly from the upper end level of the annular flange 142. One of the positioning holes 158 is formed in the mounting plate 130, on the lower surface side of the boss portion and at a position coaxial with the positioning pin 159, and this positioning hole 158 is not shown.

The so constituted receiving base 78 is removably mounted on the base 74 in such a manner as to cover the replenishment opening shutter member 76 from above and such that the mounting plate 130 is superposed on the top wall 80. Mainly with reference to FIGS. 19 to 23, the positioning holes 158 of the receiving base 78 are fitted with the positioning pins 98 and 99 of the body 74 to define the mounting position. The mounting screw portions 156 are aligned with the mounting holes 97 of the body 74, and the mounting plate 130 is coupled to the top wall 80 of the body 74 by means of machine screws. The cylindrical portion 134 of the receiving base 78 is inserted inside the circular wall portion 112 of the replenishment opening shutter member 76 so as to be capable of relative rotation. The engaging convex 148 of the receiving base 78 is engaged into the first notch 94 of the base 74. The lower end of the engaging convex 148 is positioned with a gap from the upper end of the first notch 126 formed in the circular wall portion 112 of the replenishment opening shutter member 76. The second notch 146 of the receiving base 78 is aligned with the second notch 96 of the base 74, and also aligned with the second notch 128 formed in the circular wall portion 112 of the replenishment opening shutter member 76. The through-holes 140 of the receiving base 78 are fitted, with a gap, over the minor diameter portions of the locking members 100. The passage openings 138 of the receiving base 78 align with the toner replenishment openings 72 of the base 74, and the intermediate space is shielded by the bottom wall 110 of the replenishment opening shutter member 76. As described above, the positional relation among the receiving base 78, the body 74, and the replenishment opening shutter member 76 is defined to constitute the mounting base 70.

The toner replenishment openings 72 of the mounting base 70 mounted on (connected to) the hopper disposed in the developing device (not shown) are normally closed with the replenishment opening shutter member 76, as stated earlier. Thus, the fall of things into the hopper or the contamination of the toner by foreign matter is prevented reliably. When the mounting base 70 is used in the hopper of the type to be slid and mounted on the main body of the image forming machine, on the other hand, the outward leakage of the toner in the hopper through the toner replenishment openings 72 owing to vibrations during mounting, etc. can be prevented without fail. Thus, contamination of the surroundings or a waste of the toner can be prevented. Consequently, disadvantages such as deterioration of the developing function or damage to the developing device can be surely prevented, and formation of a satisfactory image is ensured.

The following is an explanation for the procedure of replenishing a toner from the toner cartridge 2 of the foregoing constitution into the hopper (not shown) through the toner replenishment openings 72 of the mounting base 70. First, the toner cartridge 2 is mounted on the mounting base 70 (is located at the replenishing position) in the following manner: Mainly with reference to FIGS. 1 to 3, FIG. 19 and FIGS. 36 to 38, the first cylindrical portion 42 of the container shutter member 10 of the toner cartridge 2 is inserted into the cylindrical portion 134 of the receiving base 78. The lower surface of the flange 52 of the container shutter member 10 is positioned on the upper end of the annular flange 142 of the receiving base 78. At this time, the positioning hole 56 provided in the container shutter member 10 is fitted over the positioning pin 159 of the mounting base 70. Also, the locking engaging piece 28 of the main member 8 and the locking flange portion 34 of the locking member 30 mounted on the main member 8 are inserted into the first notch 144 of the receiving base 78, while the turning engaging piece 26 of the main member 8 is inserted into the second notch 146 of the receiving base 78. The locking release pins 50 of the container shutter member 10 align with the corresponding through-holes 140 of the receiving base 70 and locking members 100, pushing the locking members 100 axially downwards to bring them to the locking release position.

Upon the fitting of the positioning hole 56 of the container shutter member 10 over the positioning pin 159 of the mounting base 70, the positioning of the container shutter member 10 relative to the receiving base 78 is performed, and its turning is inhibited. Also, because the locking engaging piece 28 of the main member 8 and the locking flange portion 34 are inserted into the first notch 144 of the receiving base 78, the locking flange portion 34 contacts the upper end of the projection 150 provided in the first notch 144, and is relatively moved axially upwardly along the first notch 60 of the main member 8 against the elastic force of the locking member 30. As a result, the locking claw portion 36 is removed from the notch 29 of the flange 24 of the main member 8 (i.e., is located at the locking release position), whereby the locking by the locking member 30 is released. Also, the turning engaging piece 26 of the main member 8 is inserted into the second notch 146 of the receiving base 78, so that the front end of the turning engaging piece 26 is engaged with the second notch 128 of the replenishment opening shutter member 76. In this manner, the toner cartridge 2 is put to the replenishing position on the mounting base 70.

Then, when the container 4 of the toner cartridge 2 is turned about 90° in a predetermined direction (clockwise in FIGS. 1 and 19) together with the main member 8, the main member 8 is turned through the same angle relative to the container shutter member 10. The replenishment opening shutter member 76 is also turned through the same angle (from the position of FIG. 39 to the position of FIG. 40) integrally with the main member 8, because the turning engaging piece 26 is engaged with the second notch 128 of the replenishment opening shutter member 76. The locking engaging piece 28 of the main member 8 is turned along the first slit 152 of the receiving base 78, and the turning engaging piece 26 is turned along the second slit 154. Both pieces contact the ends of the corresponding slits 152 and 154, whereupon their turning is restrained, so that the turning of the main member 8 is stopped. The main member 8 and the replenishment opening shutter member 76 are turned from the open position to the closed position and positioned there. Thus, the through-holes 20 of the main member 8, the passage openings 48 of the container shutter member 10, the passage openings 138 of the receiving base 78, the passage openings 114 of the replenishment opening shutter member 76, and the toner replenishment openings 72 of the body 74 are all brought into alignment, whereupon the toner accommodated in the container 4 is discharged into the hopper.

To remove the toner cartridge 2 from the mounting base 70 after supply of the toner from the toner cartridge 2 into the hopper for replenishment, the container 4 of the toner cartridge 2 is turned together with the main member 8 about 90° in the direction opposite to the direction mentioned above, whereby the toner cartridge 2 can be returned to the replenishing position. Each of the toner replenishment openings 72 is closed with the replenishment opening shutter member 76, while each of the through-holes 20 of the main member 8 is closed with the container shutter member 10. The locking engaging piece 28 of the main member 8 aligns with the first notch 144 of the receiving base 78, and the turning engaging piece 26 aligns with the second notch 146 of the receiving base 78. Thus, the toner cartridge 2 becomes movable axially upwardly, in the removing direction, with respect to the mounting base 70.

By moving the toner cartridge 2 slightly upwards relative to the mounting base 70, the locking claw portion 36 of the locking member 30 is engaged, because of its elasticity, with the notch 29 of the flange 24 of the main member 8 to be brought to a locked state (positioned to the locking position). As a result, the through-holes 20 of the main member 8 are locked in a closed state by the container shutter member 10. According to the upward movement of the toner cartridge 2, the locking release pins 50 of the container shutter member 10 are separated upwardly of the locking member 100. Thus, the locking member 100 is raised to the locking position by the spring force of the spring member 102, whereby the turning of the replenishment opening shutter member 76 is inhibited. Thus, the toner replenishment openings 72 are locked in a closed state by the replenishment opening shutter member 76. Then, the toner cartridge 2 is moved axially upwards from the mounting base 70, whereby the toner cartridge 2 can be removed completely from the mounting base 70. The upward movement of the toner cartridge 2 can also be performed by the spring force of the spring member 102.

Figure 41:
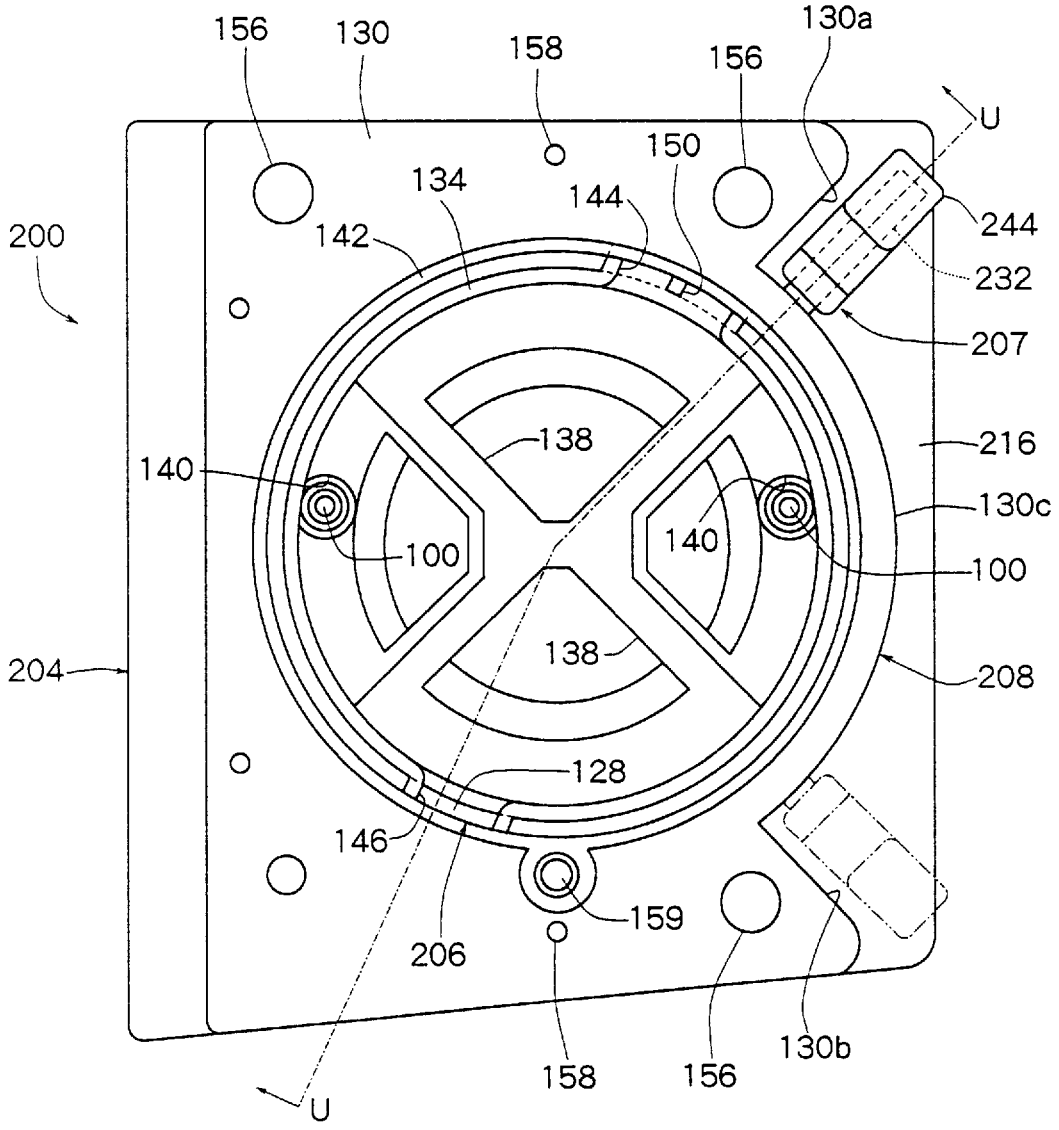
FIG. 41 is a plan view showing another embodiment of the mounting base.
Figure 42:
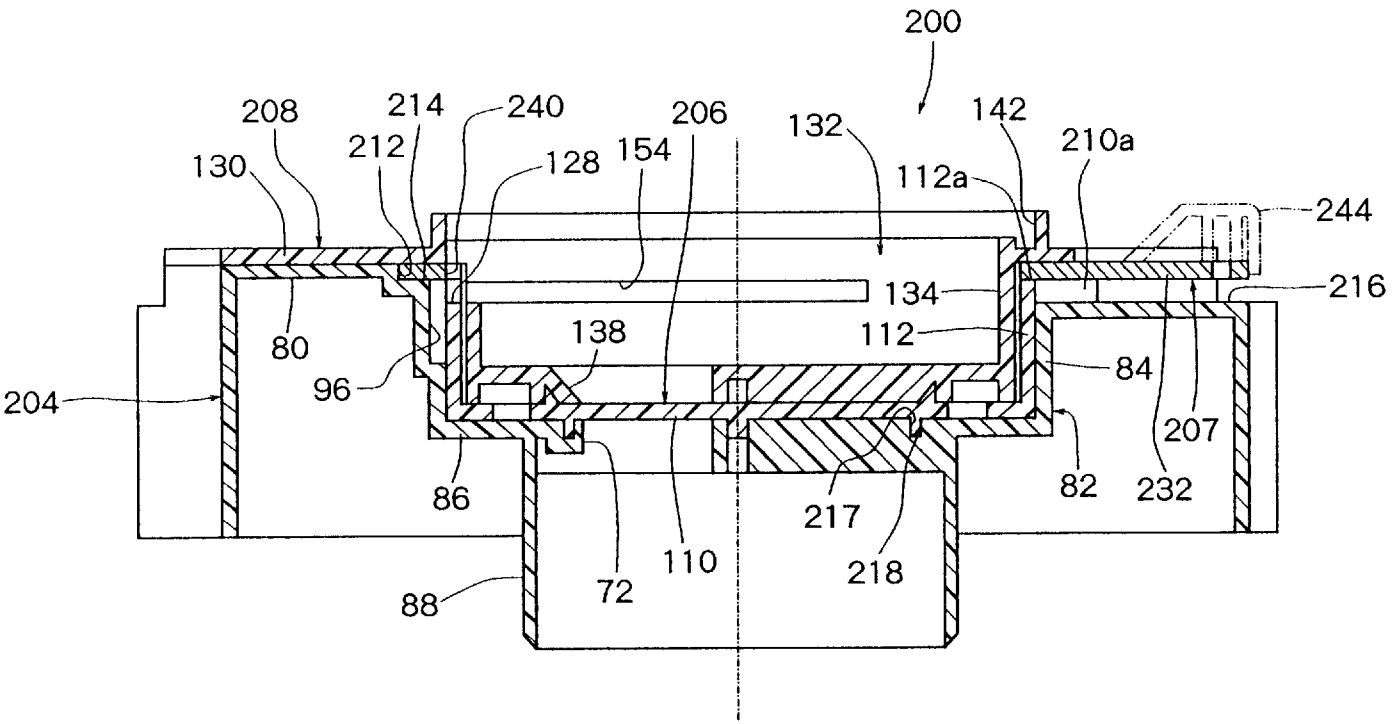
FIG. 42 is a sectional view taken on line U—U of FIG. 41.

Next, FIGS. 41 to 49 show another embodiment of a mounting base on which the toner cartridge 2 is mounted removably. FIGS. 41 and 42 show a mounting base 200. The mounting base 200 includes a body 204 mounted on the hopper of a developing device (not shown) and having toner replenishment openings 72 formed for replenishing a toner, a replenishment opening shutter member 206 removably mounted on the body 204, an operating lever member 207 mounted on the top of the replenishment opening shutter member 206 so as to be turnable integrally therewith, and a receiving base 208 removably mounted on the body 204 so as to cover from above the replenishment opening shutter member 206 including the operating lever member 207. The body 204, replenishment opening shutter member 206 and receiving base 208 that constitute the mounting base 200 are partial improvements in the constitutions of the body 74, replenishment opening shutter member 76 and receiving base 78 that constitute the mounting base 70 previously described with reference to FIGS. 19 to 35. Hereinafter, therefore, the following description will focus on the differences in constitution. Of the respective members shown in FIGS. 41 to 49, substantially the same parts as the corresponding members shown in FIGS. 19 to 35 will be indicated by the same numerals, and explanations will be omitted.

Figure 43:
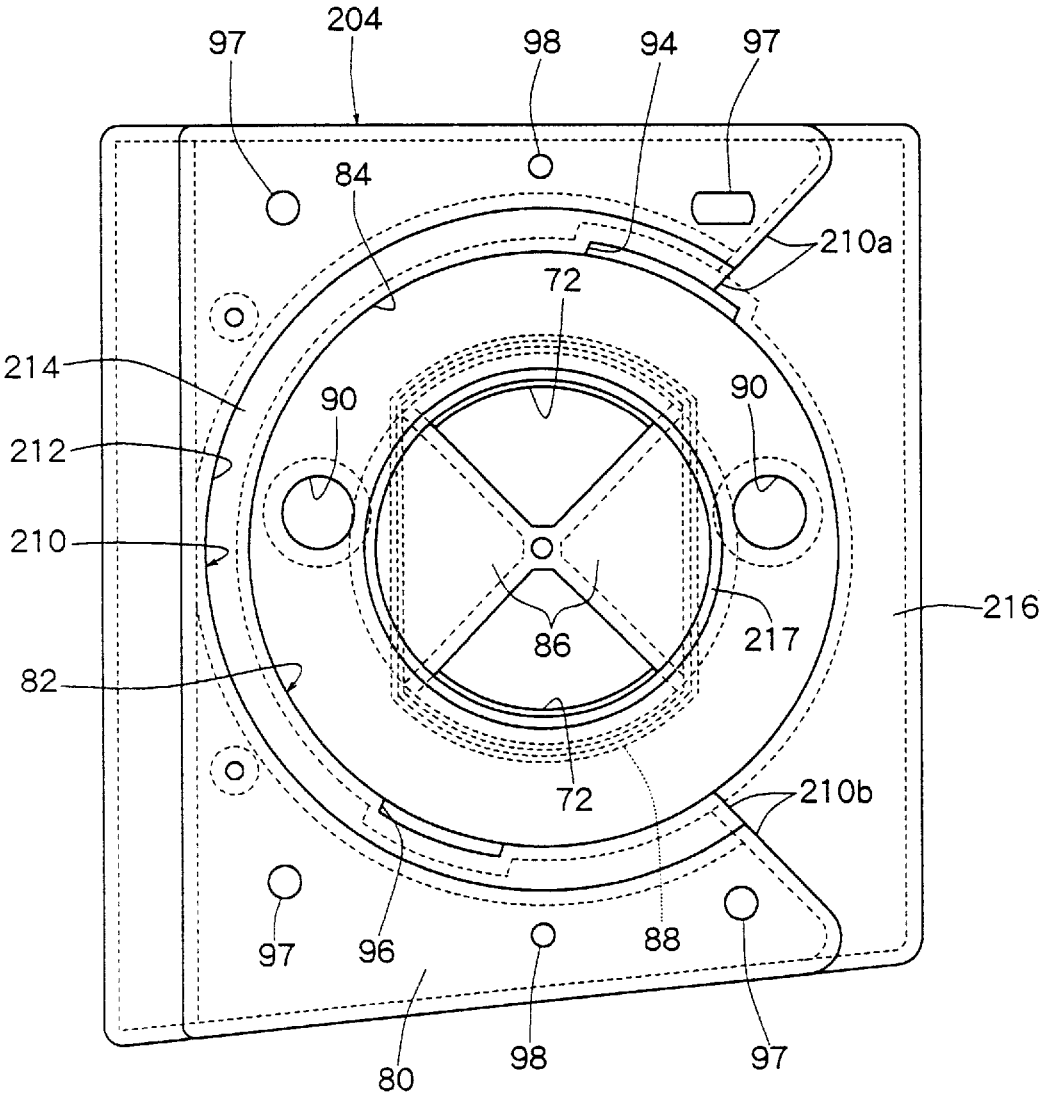
FIG. 43 is a plan view showing another embodiment of the body of the mounting base.

FIGS. 42 and 43 show that at the upper end of a cylindrical portion 84 in a top wall 80 of the body 204, an arcuate concave 210 at a lower level than the flat top surface of the top wall 80 is formed so as to extend along that upper end. The concave 210 has an arcuate wall 212 with a constant height, and an arcuate bottom wall 214 extending peripherally on the same horizontal plane with a constant radial width. The concave 210 has opposite ends 210*a* and 210*b* whose positions are defined such that a space in an angular range at nearly 90°+α will be left between the opposite ends 210*a* and 210*b*. Over the entire region of the top wall 80 in the above angular range, a flat upper surface 216 at a lower level than the bottom wall 214 of the concave 210 is formed. Thus, stepped portions consistent with the opposite ends 210*a* and 210*b* of the concave 210 are formed between the opposite ends of the top wall 80, including the bottom wall 214, and the upper surface 216 at a lower level than them. The stepped portions 210*a* and 210*b* are formed so as to coincide with straight lines parallel to straight lines passing through the axis center and forming an angle of 90° with each other when viewed from the direction of the common axis of the concave 82 and the concave 210. The concave 210 constitutes a support portion for supporting a ring-shaped body 230 of the operating lever member 207 (to be described later on) turnably. The height from the bottom wall 214 to the top surface of the top wall 80 is equal to or slightly greater than the thickness of the operating lever member 207. The aforementioned angular range permits the operating lever member 207 to turn about 90° integrally with the replenishment opening shutter member 206. In the bottom wall 86 of the concave 82, a ring-shaped concave (concave groove) 217 is formed. The so constituted body 204 is mounted, like the aforementioned body 74, on the upper end of the hopper disposed in the developing device of an image forming machine.

Figure 44:
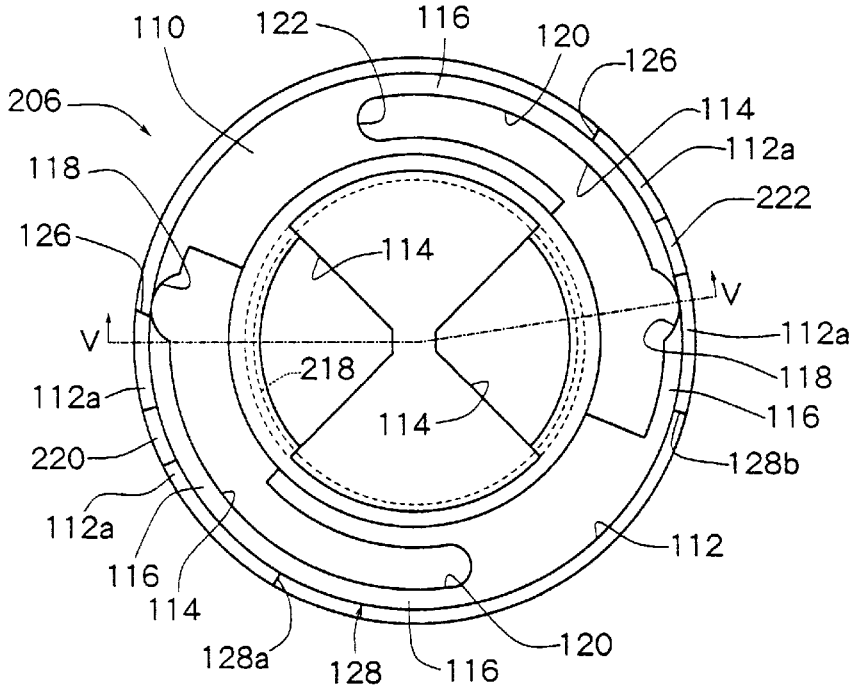
FIG. 44 is a plan view showing another embodiment of the replenishment opening shutter member.
Figure 45:
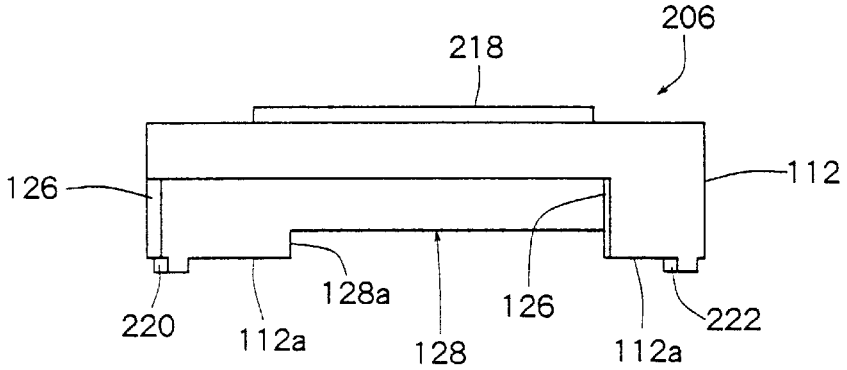
FIG. 45 is a side view of FIG. 44 as viewed from above.
Figure 46:
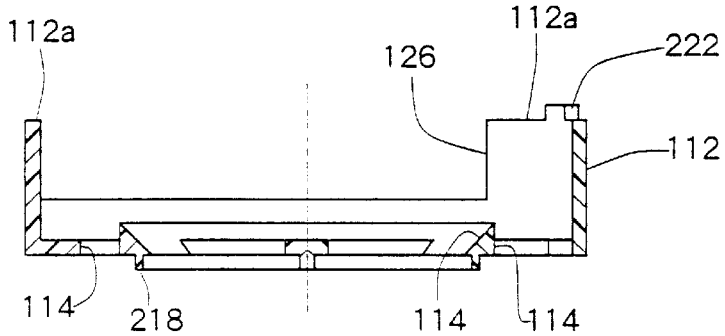
FIG. 46 is a sectional view taken on line V—V of FIG. 44.

Next, FIGS. 44 to 46 are referred to for illustrating the replenishment opening shutter member 206. On a bottom wall 110 of the replenishment opening shutter member 206, a ring-shaped convex 218 is formed which protrudes vertically downwardly. A second notch 128 of a circular wall portion 112 is formed such that its angular range in the peripheral direction from one end 128*a* to the other end 128*b* thereof will be 90°+α. As will be easily understood from a description to be given later on, one end 128*a* of the second notch 128 constitutes an engaged portion to be engaged with the turning engaging piece 26 (see FIG. 10) of the toner cartridge 2 for an opening-direction turn for turning the replenishment opening shutter member 206 from the closed position to the open position. The spacing (space) in the peripheral direction from one end 128*a* to the other end 128*b* of the second notch 128 constitutes a free play portion for permitting the closed-direction turn of the turning engaging piece 26 independently of the replenishment opening shutter member 206 for a closing-direction turn for turning the replenishment opening shutter member 206 from the open position to the closed position. That is, one end 128*a*, on the upstream side in the opening direction, of the second notch 128 of the replenishment opening shutter member 206 defines an engaged portion to be engaged with the turning engaging piece 26 of the main member 8 for the opening-direction turning. The peripheral space between the one end 128*a* and the other end 128*b*, on the downstream side in the opening direction, of the second notch 128 of the replenishment opening shutter member 206 defines the free play space.

On a flat surface 112*a* at the upper end of the circular wall portion 112 (the upper end surface on the same horizontal plane) where neither the first notch 126 nor the second notch 128 is formed, two engaging convexes 220 and 222 protruding axially upwardly are formed. The engaging convexes 220 and 222 are formed at symmetric positions with respect to the axis center of the replenishment opening shutter member 206. The height of the engaging convexes 220 and 222 from the flat surface is set to be the same as or slightly larger than the thickness of the operating lever member 207 to be described later on.

The so constituted replenishment opening shutter member 206 is inserted removably and turnably into the concave 82 of the body 204 in the mounting base 200, as shown in FIG. 42. In this mounted state (closed position), the annular convex 218 of the replenishment opening shutter member 206 is fitted turnably into the concave 217 of the body 204. The one end 128*a* of the second notch 128 of the replenishment opening shutter member 206 aligns with one end of the second notch 96 of the concave 82 (left end in FIG. 43). The flat surface 112*a* at the upper end of the circular wall portion 112 of the replenishment opening shutter member 206 is located at the same position as, or a slightly lower position than, the upper surface of the bottom wall 214 of the concave 82. The upper surfaces of the engaging convexes 220 and 222 of the replenishment opening shutter member 206 are positioned at substantially the same level as or a slightly lower level than the uppermost surface of the top wall 80 of the body 204.

Figure 47:
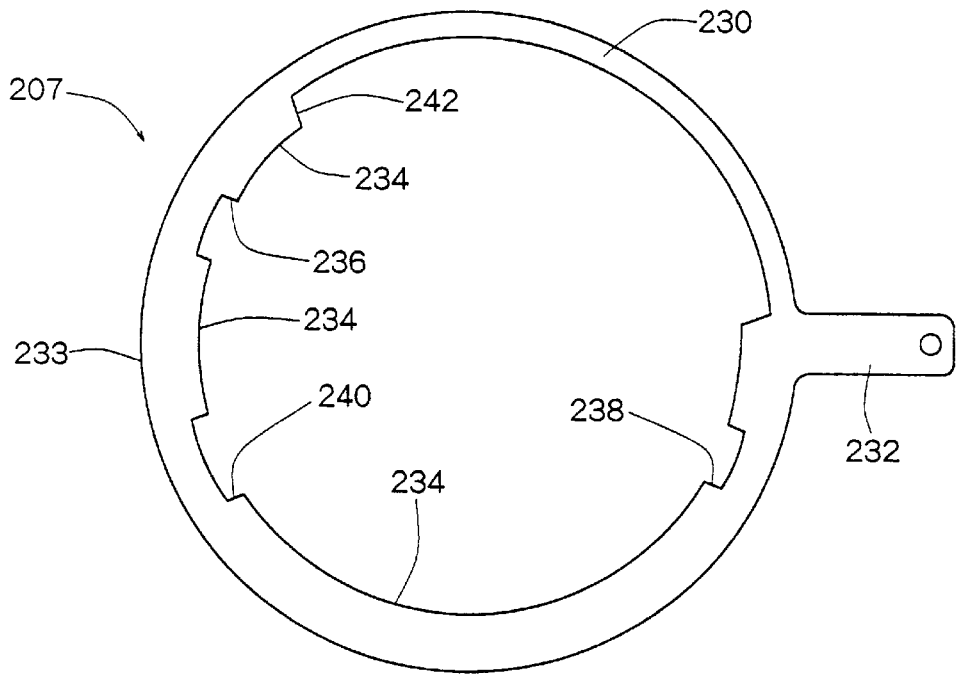
FIG. 47 is a plan view of a lever member.

Next, the operating lever member 207 will be described with reference to FIG. 47. The operating lever member 207 is formed by punching a metallic plate member having a constant thickness. The operating lever member 207 comprises a ring-shaped body 230, and an operating lever 232 extending radially outwardly of the body 230. The outer peripheral edge 233 of the body 230 has a slightly smaller radius than the radius of the wall 212 of the concave 210 in the body 204 of the mounting base 200, and thus is formed to be larger than the outside diameter of the replenishment opening shutter member 206. The inner peripheral edge 234 of the body 230 is substantially the same in diameter as the inner peripheral surface of the circular wall portion 112 of the replenishment opening shutter member 206. In the inner peripheral edge 234 of the body 230, a first notch 236, a second notch 238, a third notch 240, and a fourth notch 242 are formed. The first notch 236 and the second notch 238 are formed at symmetrical positions with respect to the axis center of the body 230. The first notch 236 and the second notch 238 are formed at peripheral positions corresponding to the engaging convexes 220 and 222 of the replenishment opening shutter member 206. Their radially outward depth (width) from the inner peripheral edge 234 is set at the same as the thickness of the circular wall portion 112 of the replenishment opening shutter member 206. The peripheral lengths of the first notch 236 and the second notch 238 are set such that the engaging convexes 220 and 222 of the replenishment opening shutter member 206 can engage the first notch 236 and the second notch 238 with substantially no gap, that is, they cannot substantially turn relatively.

The third notch 240 is formed at a peripheral position between the first notch 236 and the second notch 238 on one side of the ring-shaped member. The peripheral length of the third notch 240 is set at a length which permits the axial movement of the turning engaging piece 26 (see FIG. 10) of the toner cartridge 2. The fourth notch 242 is formed at a peripheral position between the first notch 236 and the second notch 238 on the other side of the ring-shaped member. The peripheral length of the fourth notch 242 is set to be substantially the same as the peripheral length of the first notch 126 of the replenishment opening shutter member 206, and its peripheral position is set to substantially coincide with the operating lever member 207 when the operating lever member 207 is mounted on the replenishment opening shutter member 206. The peripheral length and radially outward depth of the fourth notch 242 are also set in a range which permits the rotation of the receiving base 208 relative to the engaging convex 148 (see FIG. 35), as will be easily seen from a description to be given later on. On the operating lever 232, a plastic grip portion 244 (see a solid line in FIG. 41 and a two-dot chain line in FIG. 42) is mounted.

With reference to FIG. 41, the mounting plate 130 of the receiving base 78 has opposite ends 130*a* and 130*b* aligning with the aforementioned ends 210*a* and 210*b* of the top wall 80 of the body 204, and an arcuate portion 130*c* formed between the opposite ends 130*a* and 130*b*. The arcuate portion 130*c* has the same radius as does the wall 212 of the body 204.

Figure 48:
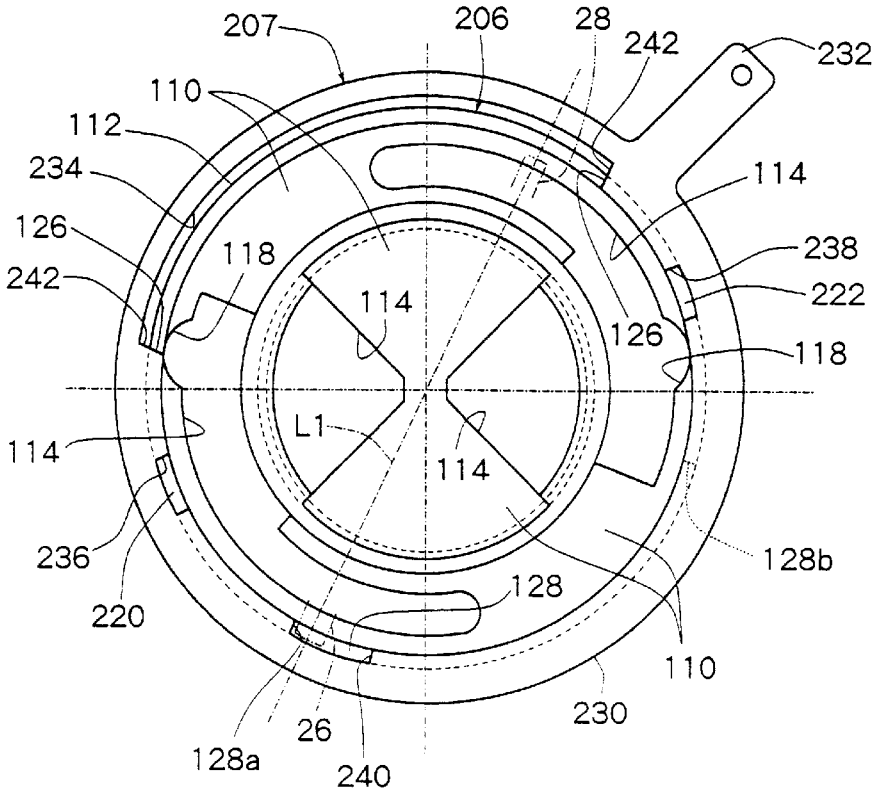
FIG. 48 is a plan view of the lever member mounted on the replenishment opening shutter member shown in FIG. 44.

With reference to FIGS. 41, 42 and 48, the operating lever member 207 has its first notch 236 and second notch 238 engaged with the engaging convexes 220 and 222 of the replenishment opening shutter member 206 fitted turnably in the concave 82 of the body 204. Thus, the operating lever member 207 is mounted so as not to be relatively rotatable, with the operating lever member 207 being placed on the flat surface 112*a* of the circular wall portion 112 of the replenishment opening shutter member 206. The upper surface of the operating lever member 207 is positioned on substantially the same plane as the upper surfaces of the engaging convexes 220 and 222. The fourth notch 242 of the operating lever member 207 aligns with the first notch 126 of the replenishment opening shutter member 206. One end of the third notch 240 (the left end of FIG. 48) of the operating lever member 207, i.e., one upstream end in the opening direction, aligns with one end 128*a* of the second notch 128 of the replenishment opening shutter member 206, i.e., one upstream end in the opening direction. The lower surface of the operating lever member 207 radially outward of its part placed on the flat surface 112*a* of the circular wall portion 112 is rotatably borne on the bottom wall 214 of the arcuate concave 210 of the body 204. The operating lever 232 of the operating lever member 207 is positioned, with spacing, above the low-level upper surface 216 of the body 204, and close to the end 210*a*, i.e., one downstream end in the opening direction of the arcuate concave 210.

With reference to FIGS. 41, 42 and 48, the receiving base 78 is removably and relatively rotatably mounted on the body 204 so as to cover from above the replenishment opening shutter member 206 in the closed position and the operating lever member 207. The cylindrical portion 134 of the receiving base 208 is relatively rotatably inserted inside the circular wall portion 112 of the replenishment opening shutter member 206 and the inner peripheral edge 234 of the operating lever member 207. The engaging convex 148 of the receiving base 208 (see FIG. 35) is engaged into the first notch 94 of the body 204, and is positioned relatively rotatably in the fourth notch 242 of the operating lever member 207. Also, the engaging convex 148 (see FIG. 35) is positioned near one end (the right end of FIG. 48) each of the fourth notch 242 of the operating lever member 207 and the first notch 126 of the replenishment opening shutter member 206. The lower end of the engaging convex 148 is positioned with spacing from the upper end of the first notch 126 formed in the circular wall portion 112 of the replenishment opening shutter member 206. The second notch 146 of the receiving base 208 is aligned with the notch 240 of the operating lever member 207, the second notch 96 of the base 204 (FIG. 43), and the third notch 240 of the operating lever member 207. Also, one end (left end in FIG. 41) of the second notch 146 is aligned with one end (left end in FIG. 48) of the notch 240 of the operating lever member 207 and one end 128*a* of the second notch 128 formed in the circular wall portion 112 of the replenishment opening shutter member 206.

Next, an explanation will be offered for the procedure of supplying, for replenishment, a toner from the toner cartridge 2 of the foregoing constitution into the hopper (not shown) through the toner replenishment opening 72 of the mounting base 200. The basic procedure for mounting the toner cartridge 2 at the replenishing position on the mounting base 200, turning it relatively, and removing, and the actions of the respective parts are substantially the same as the procedure and actions related to the mounting base 70. Thus, an explanation is given mainly for the operation and actions that are different. With reference to FIGS. 41, 42, 48 and 49, with the toner cartridge 2 being mounted at the replenishing position, the turning engaging piece 26 of the toner cartridge 2 is inserted into the second notch 146 of the receiving base 208. As a result, the turning engaging piece 26 is positioned into the second notch 128 of the replenishment opening shutter member 206 via the third notch 240 of the operating lever member 207. One end on the upstream side in the opening direction of the turning engaging piece 26 is positioned close to one end 128*a* of the second notch 128 of the replenishment opening shutter member 206. The turning engaging piece 26 and locking engaging piece 28 of the toner cartridge 2 are positioned on line L1 in FIG. 48.

Then, the container 4 of the toner cartridge 2 is turned about 90° in a predetermined direction, the opening direction (clockwise in FIG. 41), together with the main member 8. Thus, the main member 8 is turned through the same angle relative to the container shutter member 10. The replenishment opening shutter member 206 is also turned through the same angle integrally with the main member 8, since the turning engaging piece 26 is contacted with one end 128*a* of the second notch 128 of the replenishment opening shutter member 206. The operating lever 232 of the operating lever member 207 to be turned integrally with the replenishment opening shutter member 206 is turned from a position close to the end 210*a* of the body 204 to a position close to the other end 210*b* (the position indicated by a two-dot chain line in FIG. 41). The replenishment opening shutter member 206 and the operating lever member 207 are turned clockwise from the position in FIG. 48 to the position in FIG. 49. The turning engaging piece 26 and locking engaging piece 28 of the toner cartridge 2 are positioned on the line L2 in FIG. 49. One end (left end in FIG. 48) of each of the fourth notch 242 of the operating lever member 207 and the first notch 126 of the replenishment opening shutter member 206 are turned to a position close to the engaging convex 148 of the receiving base 208 (see FIG. 35). As explained earlier, the through-holes 20 of the main member 8, the passage openings 48 of the container shutter member 10, the passage openings 138 of the receiving base 208, the passage openings 114 of the replenishment opening shutter member 206, and the toner replenishment openings 72 of the body 204 are all aligned, whereupon the toner accommodated in the container 4 is discharged into the hopper.

To remove the toner cartridge 2 from the mounting base 200 after supply of the toner from the toner cartridge 2 into the hopper for replenishment, the container 4 of the toner cartridge 2 is turned about 90° together with the main member 8 in the direction opposite to the aforementioned direction, i.e., the closing direction (counterclockwise in FIG. 41), whereby the toner cartridge 2 can be returned to the replenishing position. Upon this turning, the turning engaging piece 26 of the toner cartridge 2 leaves one end 128*a* of the second notch 128 of the replenishment opening shutter member 206, and turns independently of the replenishment opening shutter member 206 and the operating lever member 207 (i.e., freely plays) along the second notch 128), stopping at a position close to the other end 128*b* (the position shown in the line L1 of FIG. 49). By this action, the operating lever member 207 and the replenishment opening shutter member 206 are left at the opening position (the position shown in FIG. 49) to which they have been turned 90° clockwise from the home position shown in FIG. 48. The through-holes 20 of the main member 8 are closed with the container shutter member 10. Thus, the through-holes 20 of the main member 8 are closed with the container shutter member 10, while the passage openings 138 of the receiving base 208 and the toner replenishment openings 72 are held in the state opened by the replenishment opening shutter member 206. As a result, even if the remaining toner in the toner cartridge 2 falls in the process of closure of the through-holes 20 of the toner cartridge 2, the toner replenishment openings 72 are open. Thus, no toner accumulates on the upper surface of the replenishment opening shutter member 206, so that the staining of the replenishment opening shutter member 206 and the surroundings with toner is prevented.

Figure 49:
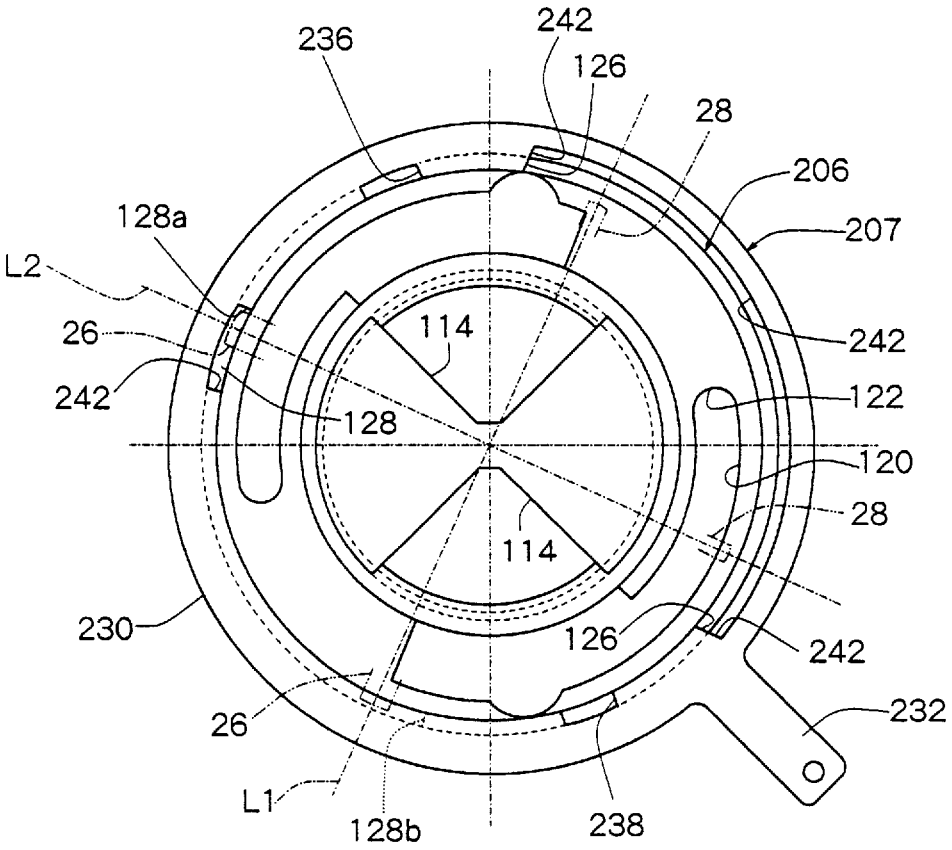
FIG. 49 is a plan view showing a state in which the replenishment opening shutter member and lever member illustrated in FIG. 48 are integrally turned 90° clockwise.

As clear from FIG. 49, the operating lever member 207 and the replenishment opening shutter member 206 are left at the opening position (the position shown in FIG. 49) to which they have been turned 90° clockwise from the home position shown in FIG. 48, and the turning engaging piece 26 of the toner cartridge 2 is turned from the position on line L2 to the position on line L1. Even when, in this state, the toner cartridge 2 is to be removed from the mounting base 200, the inner edge side of the operating lever member 207 overhangs the second notch 128 of the replenishment opening shutter member 206. As a result, the movement of the turning engaging piece 26 of the toner cartridge 2 in the removing direction is inhibited because of interference by the overhang area. Thus, the removal of the toner cartridge 2 from the mounting base 200 with the toner replenishment openings 72 open is inhibited without fail. Consequently, the fall of things into the hopper or the contamination of the toner by foreign matter is prevented reliably.

Then, the operating lever 232 is turned 90° counterclockwise in FIG. 41, whereby the operating lever member 207 and the replenishment opening shutter member 206 are turned from the open position in FIG. 49 to the closed position in FIG. 48. The replenishment opening shutter member 206 are brought to the closed position, and the toner replenishment openings 72 are closed. Then, the toner cartridge 2 is moved from the mounting base 200 axially upwardly, whereby the toner cartridge 2 can be removed from the mounting base 200 completely.

The preferred embodiments of the toner replenishing device and the toner cartridge for use therein that are constructed in accordance with the present invention have been described with reference to the accompanying drawings. However, it is to be understood that the invention is not limited thereto, but various changes and modifications may be made without departing from the spirit and scope of the invention. For example, the replenishment opening shutter member 206 in these embodiments is adapted to be turnable in the closing direction by the operating lever 232 of the operating lever member 207 mounted at the upper end. However, the operating lever 232 may be provided integrally with the replenishment opening shutter member 206.

What we claim is:

1. A toner replenishing device comprising a mounting base having a toner replenishment opening formed for replenishing a hopper with a toner, and a toner cartridge removably mounted on the mounting base at a replenishing position at which the toner can be replenished through the toner replenishment opening; said toner cartridge having a container for accommodating the toner, and a shutter mechanism disposed in a lower end part of the container; said shutter mechanism having a main member substantially integral with the container and including a bottom wall where a through-hole is formed, and a container shutter member including a bottom wall where a passage opening is formed, and being disposed outside the main member so as to be turnable relative to the main member between a closed position at which it closes the through-hole and an open position at which it opens the through-hole upon the alignment of the passage opening with the through-hole; said container shutter member having rotation inhibited means disposed for engagement with rotation inhibiting means disposed on the mounting base; wherein said mounting base is provided with a replenishment opening shutter member mounted so as to be turnable between a closed position at which it closes the toner replenishment opening and an open position at which it opens the toner replenishment opening, and locking means including a locking pin member movable between a locking position at which it inhibits the turn of the replenishment opening shutter member to hold the replenishment opening shutter member at the closed position, and a locking release position at which it allows the turn; said container shutter member has locking release means disposed thereon; and said main member has engaging means disposed which can engage engaged means disposed on the replenishment opening shutter member to turn the replenishment opening shutter member;

by engaging the rotation inhibited means of the container shutter member with the rotation inhibiting means of the mounting base, the toner cartridge is mounted at the replenishing position, whereby the locking release means of the container shutter member moves the locking pin member of the mounting base to the locking release position, and the engaging means of the main member is engaged with the engaged means of the replenishment opening shutter member; and by turning the container relative to the container shutter member, the container shutter member is turned relative to the main member to the open position, the replenishment opening shutter member is turned to the open position, and the through-hole and the toner replenishment opening align with each other.

2. The toner replenishing device of claim 1, wherein said mounting base has a body; said body has a top wall extending horizontally, and a concave extending from the top wall vertically downwardly; said concave has a cylindrical portion, and a bottom wall extending horizontally at the lower end of the cylindrical portion; said toner replenishment openings are formed in the bottom wall; said replenishment opening shutter member has a bottom wall extending horizontally and having a circular peripheral edge, and a circular wall portion extending upwardly from the peripheral edge of the bottom wall, and is mounted removably and turnably in the concave; a passage opening is formed in the bottom wall of the replenishment opening shutter member; and when the replenishment opening shutter member rests at the close position, the toner replenishment opening of the body is closed with the bottom wall of the replenishment opening shutter member, while when the replenishment opening shutter member rests at the open position, the passage opening and the toner replenishment opening align.

3. The toner replenishing device of claim 2, wherein said locking means has a concave extending downwardly from a position close to a peripheral edge part of the bottom wall of the body and having the lower end closed with a bottom wall, the locking pin member inserted axially movably into the concave, and a spring member disposed in the concave for supporting the locking pin member at the locking position at which part of the locking pin member protrudes from the concave; said passage opening of the replenishment opening shutter member has an arcuate part; an arcuate band portion is formed between said arcuate part and the peripheral edge of the bottom wall of the replenishment opening shutter member; an arcuate notch is formed in said band portion; and said notch is releasably engaged with part of the outer peripheral surface of the locking pin member at the locking position, whereby the replenishment opening shutter member is locked, and its turning is inhibited, to maintain the closed position.

4. The toner replenishing device of claim 3, wherein the outer peripheral surface of the locking pin member includes a major diameter portion and a minor diameter portion formed on the upper end of the major diameter portion; said one part of the outer peripheral surface of the locking pin member which said notch engages is part of the outer peripheral surface of the major diameter portion; an arcuate slit extending in the peripheral direction from one peripheral end of the passage opening is formed in the bottom wall of the replenishment opening shutter member; the radially outward peripheral surface of the slit is positioned on a continuous peripheral surface having an axis center substantially common to the peripheral surface of the arcuate portion of the passage opening; the width of the slit is formed to be larger than the diameter of the minor diameter portion; at said locking release position, the major diameter portion of the locking pin member is positioned below the bottom wall of the replenishment opening shutter member, whereby the engagement of the locking pin member with the notch is released; and the turning in the opening direction of the replenishment opening shutter member from the closed position to the opening position is permitted because the slit moves while accommodating the minor diameter portion of the corresponding locking pin member.

5. The toner replenishing device of claim 4, wherein a first notch and a second notch are formed in the cylindrical portion of the concave of the body; the first notch and the second notch are arranged at symmetrical positions with respect to the axis center of the cylindrical portion, and each extend from the upper end of the cylindrical portion toward the bottom wall of the body with a predetermined peripheral width; a first notch and a second notch constituting engaged means are formed in the cylindrical portion of the replenishment opening shutter member; the first notch and the second notch of the replenishment opening shutter member are arranged at symmetrical positions with respect to the axis center of the replenishment opening shutter member, and each extend from the upper end of the cylindrical portion toward the bottom wall of the replenishment opening shutter member with a predetermined peripheral width; when the replenishment opening shutter member is at the closed position, the second notch of the replenishment opening shutter member aligns with the second notch of the body in terms of the peripheral position, one end, on the upstream side in the opening direction, of the first notch of the replenishment opening shutter member aligns with one end, on the upstream side in the opening direction, of the first notch of the body, the other end, on the downstream side in the opening direction, of the first notch of the replenishment opening shutter member is positioned at a peripheral position between the other end, on the downstream side in the opening direction, of the first notch of the body and the second notch of the body, and the upper end of the circular wall portion of the replenishment opening shutter member is positioned at a lower level than the upper surface of the top wall of the body; and when the replenishment opening shutter member is turned from the closed position to the open position, the other end of the first notch of the replenishment opening shutter member is positioned at a position not beyond the other end of the first notch of the body in the opening direction.

6. The toner replenishing device of claim 5, wherein the mounting base includes a receiving base; said receiving base has a mounting plate extending horizontally, and a concave extending from the mounting plate vertically downwardly; said concave has a cylindrical portion, and a bottom wall extending horizontally at the lower end of the cylindrical portion; a passage opening and a through-hole are formed in said bottom wall; said through-hole has a diameter which enables the minor diameter portion of the locking member to be removably fitted into the through-hole; the outside diameter of said cylindrical portion is set to be smaller than the inside diameter of the circular wall portion of the replenishment opening shutter member; a first notch and a second notch, an engaging convex, and a first slit and a second slit are formed in said cylindrical portion; said first notch and second notch are arranged at symmetrical positions with respect to the axis center of the cylindrical portion, and each extend from the upper end of the cylindrical portion toward the bottom wall of the receiving base with a predetermined peripheral width; said engaging convex comprises side walls extending radially outwardly from the opposite ends in the peripheral direction of the first notch, an arcuate wall extending between the outer ends in the radial direction of the side walls, and a bottom wall extending between the lower ends of the side walls; a projection extending radially inwardly from the inner peripheral surface of the arcuate wall is formed in the arcuate wall; said first slit and second slit extend from one end of the first notch and one end of the second notch, respectively, over a predetermined length toward the opening direction of the replenishment opening shutter member; said receiving base is removably mounted on the body, with the replenishment opening shutter member being at the closed position, such that the mounting plate is superposed on the top wall of the body; and with the receiving base being mounted on the body, the engaging convex of the receiving base is fitted into the first notch of the body, whereby the cylindrical portion of the receiving base is positioned relatively turnably inside the circular wall portion of the replenishment opening shutter member, the lower end of the engaging convex is positioned with a gap from the upper end of the first notch of the replenishment opening shutter member, the second notch of the receiving base is aligned with the second notch of the replenishment opening shutter member and also with the second notch of the body in terms of the peripheral position, the through-hole of the receiving base is fitted over the minor diameter portion of the locking pin member so as to be relatively movable in the axial direction; and the passage opening of the receiving base is aligned with the toner replenishment opening of the base, with the passage opening being shielded by the bottom wall of the replenishment opening shutter member.

7. The toner replenishing device of claim 6, wherein between the container shutter member and the main member of the toner cartridge, a locking member is disposed so as to be axially movable between a locking position at which it inhibits the relative turning of the container shutter member and the main member and a locking release position at which it allows their relative turning; and the locking member is moved axially upwardly to be brought from the locking position to the locking release position.

8. The toner replenishing device of claim 7, wherein the container shutter member and the main member of the toner cartridge each have a cylindrical portion; said cylindrical portion of the main member is positioned radially inwardly of the cylindrical portion of the container shutter member; a first notch and a second notch extending axially, and a first slit and a second slit are formed in the cylindrical portion of the container shutter member; said first notch and second notch are arranged at symmetrical positions with respect to the axis center of the cylindrical portion, and each extend from the upper end of the cylindrical portion toward the bottom wall of the container shutter member with a predetermined peripheral width; said first slit and second slit extend from one end of the first notch and one end of the second notch, respectively, over a predetermined length toward the opening direction of the container shutter member; on the outer peripheral surface of the cylindrical portion of the main member, there are formed an annular concave, a locking engaging piece disposed so as to extend radially outwardly through the first notch and to be relatively movable along the first slit, and a turning engaging piece constituting the engaging means that is disposed so as to extend radially outwardly through the second notch and to be relatively movable along the second slit; said locking member has a body portion formed from an elastic plate member of synthetic resin, having two ends and assuming a spiral shape, and a locking portion formed at one of the ends; said locking member is mounted in the annular concave so as to be deformed in a circular shape in which the ends thereof face each other in a substantially peripheral direction, and the locking portion is positioned in the first notch so as to be movable in the axial direction but substantially immovable in the peripheral direction; and the locking portion is urged axially downwardly because of its elasticity to be brought to the locking position at which it inhibits the movement of the locking engaging piece.

9. The toner replenishing device of claim 8, wherein the locking portion at the locking position, when undergoing a force for directing it axially upwardly against the urging, is moved in the same direction along the notch to be brought to the locking release position at which it permits the movement of the locking engaging piece.

10. The toner replenishing device of claim 8, wherein the locking portion has a locking flange portion extending radially outwardly, and a locking claw portion extending from the locking flange portion axially downwardly; the annular concave includes a pair of flanges extending along the outer peripheral surface of the cylindrical portion of the main member and positioned with spacing in the axial direction; the locking engaging piece, the turning engaging piece, and a notch are formed in one of the flanges positioned at a lower level in the axial direction; the locking engaging piece and the notch formed on the one flange are positioned within the peripheral width of the first notch formed in the cylindrical portion of the container shutter member; the notch formed in the one flange is positioned on the first slit side; the locking position of the locking member is defined by the fitting of the locking claw portion into the notch formed in the one flange; and the locking release position is defined by the axially upward removal of the locking claw portion from the notch formed in the one flange.

11. The toner replenishing device of claim 10, wherein the locking release means of the container shutter member comprises a locking release pin downwardly protruding from the bottom wall of the container shutter member; with the toner cartridge being mounted on the mounting base at the replenishing position, the cylindrical portion of the container shutter member is positioned in the cylindrical portion of the receiving base, the locking engaging piece of the main member and the locking flange portion of the locking member mounted on the main member are positioned in the first notch of the receiving base, the turning engaging piece of the main member is positioned in the second notch of the receiving base and also in the second notch of the replenishment opening shutter member, the locking member mounted on the main member is positioned at the locking release position because the projection formed in the first notch of the receiving base moves the locking flange portion axially upwardly, the locking release pin aligns with the through-hole of the receiving base to move the locking pin member of the body, against the urging force of the spring member, from the locking position at which the locking pin member of the base engages the arcuate notch of the replenishment opening shutter member to the locking release position at which this engagement with the notch is released; and the container of the toner cartridge is turned together with the main member relative to the container shutter member, whereby the main member is turned from the closed position to the open position, the locking engaging piece of the main member is turned along the first slit of the receiving base, the turning engaging piece of the main member is turned along the second slit of the receiving base to turn the replenishment opening shutter member from the closed position to the open position, whereupon the through-holes of the main member, the passage opening of the container shutter member, the passage opening of the receiving base, the passage opening of the replenishment opening shutter member, and the toner replenishment opening of the base are brought into alignment.

12. The toner replenishing device of claim 11, wherein an annular flange overhanging radially outwardly horizontally is formed on the outer peripheral surface of the cylindrical portion of the container shutter member; the rotation inhibiting means comprises a positioning pin disposed so as to protrude upwardly from the receiving base; the rotation inhibited means comprises a positioning hole formed in the flange of the container shutter member so as to be removably engaged with the positioning pin; and the replenishing position is defined by the engagement of the positioning hole with the positioning pin.

13. The toner replenishing device of claim 12, wherein an annular flange is formed on the upper surface of the mounting plate of the receiving base; the inside diameter of the annular flange is formed to be larger than the outside diameter of the circular wall portion of the replenishment opening shutter member; the positioning pin is disposed so as to protrude upwardly from the upper end of the annular flange; and with the toner cartridge being mounted at the replenishing position, the flange of the container shutter member is placed on the upper end of the annular flange of the receiving base.

14. The toner replenishing device of claim 1, wherein an operating lever extending radially outwardly of the replenishment opening shutter member is disposed on the replenishment opening shutter member so as to be turnable integrally with the replenishment opening shutter member; the engaged means of the replenishment opening shutter member has an engaged portion to be engaged with the engaging means of the main member for an opening-direction turn for turning the replenishment opening shutter member from the closed position to the open position, and a free play space portion for permitting the closing-direction turn of the engaging means of the main member independently of the replenishment opening shutter member, said closing-direction turn being performed for turning the replenishment opening shutter member from the open position to the closed position; and the closing-direction turn of the replenishment opening shutter member is performed by the operating lever.

15. The toner replenishing device of claim 14, wherein said mounting base has a body; said body has a top wall extending horizontally, and an annular concave extending from the top wall vertically downwardly; said annular concave has a cylindrical portion, and a bottom wall extending horizontally at the lower end of the cylindrical portion; said toner replenishment opening is formed in the bottom wall; at the upper end of the cylindrical portion, an arcuate concave at a lower level than the upper surface of the top wall is formed along the upper end; said arcuate concave has an arcuate wall with a constant height, and an arcuate bottom wall extending peripherally on the same horizontal plane with a constant radial width; a space in a predetermined angular range is formed between the opposite ends of the arcuate concave; a flat upper surface at a lower level than the arcuate bottom wall is formed in the top wall over the entire region in the angular range; said replenishment opening shutter member has a bottom wall extending horizontally and having a circular peripheral edge, and a circular wall portion extending upwardly from the peripheral edge of the bottom wall, and is mounted removably and turnably in the annular concave; a passage opening is formed in the bottom wall of the replenishment opening shutter member; and when the replenishment opening shutter member rests at the closed position, the toner replenishment opening of the body is closed with the bottom wall of the replenishment opening shutter member, while when the replenishment opening shutter member rests at the open position, the passage opening and the toner replenishment opening align.

16. The toner replenishing device of claim 15, wherein said locking means has a concave extending downwardly from a position close to a peripheral edge part of the bottom wall at the lower end of the cylindrical portion of the body and having the lower end closed with a bottom wall, the locking pin member inserted axially movably into the concave, and a spring member disposed in the concave for supporting the locking pin member at the locking position at which part of the locking pin member protrudes from the concave; the passage opening of the replenishment opening shutter member has an arcuate part; an arcuate band portion is formed between said arcuate part and the peripheral edge of the bottom wall of the replenishment opening shutter member; an arcuate notch is formed in said band portion; and said notch is releasably engaged with part of the outer peripheral surface of the locking pin member at the locking position, whereby the replenishment opening shutter member is locked and its turning inhibited, to maintain the closed position.

17. The toner replenishing device of claim 16, wherein the outer peripheral surface of the locking pin member includes a major diameter portion and a minor diameter portion formed on the upper end of the major diameter portion; said one part of the outer peripheral surface of the locking pin member which said notch engages is part of the outer peripheral surface of the major diameter portion; an arcuate slit extending in the peripheral direction from one peripheral end of the passage opening is formed in the bottom wall of the replenishment opening shutter member; the radially outward peripheral surface of the slit is positioned on a continuous peripheral surface having an axis center substantially common to the peripheral surface of the arcuate portion of the passage opening; the width of the slit is formed to be larger than the diameter of the minor diameter portion; at said locking release position, the major diameter portion of the locking pin member is positioned below the bottom wall of the replenishment opening shutter member, whereby the engagement of the locking pin member with the notch is released; and the turning of the replenishment opening shutter member from the closed position to the open position is permitted because the slit moves while accommodating the minor diameter portion of the locking pin member.

18. The toner replenishing device of claim 17, wherein a first notch and a second notch are formed in the cylindrical portion of the annular concave of the body; the first notch and the second notch are arranged at symmetrical positions with respect to the axis center of the cylindrical portion, and each extend from the upper end of the cylindrical portion toward the bottom wall of the body with a predetermined peripheral width; a first notch and a second notch constituting engaged means are formed in the cylindrical portion of the replenishment opening shutter member; the first notch and the second notch of the replenishment opening shutter member are arranged at symmetrical positions with respect to the axis center of the replenishment opening shutter member, and each extend from the upper end of the cylindrical portion toward the bottom wall of the replenishment opening shutter member with a predetermined peripheral width; one end, on the upstream side in the opening direction, of the second notch of the replenishment opening shutter member defines an engaged portion to be engaged with the engaging means of the main portion for the opening-direction turn; the peripheral space between the one end and the other end, on the downstream side in the opening direction, of the second notch of the replenishment opening shutter member defines the free play space; the part, where neither the first notch nor the second notch is formed, of the upper end of the circular wall portion of the replenishment opening shutter member defines the upper end surface on the same horizontal plane; on said upper end surface, two engaging convexes protruding axially upwardly are formed at symmetric positions with respect to the axis center of the replenishment opening shutter member; when the replenishment opening shutter member is at the closed position, the one end of the second notch of the replenishment opening shutter member aligns with one end in the opening direction of the second notch of the body, one end, on the upstream side in the opening direction, of the first notch of the replenishment opening shutter member aligns with one end, on the upstream side in the opening direction, of the first notch of the body, the other end, on the downstream side in the opening direction, of the first notch of the replenishment opening shutter member is positioned at a peripheral position between the other end, on the downstream side in the opening direction, of the first notch of the body and the second notch of the body, the upper end surface of the circular wall portion of the replenishment opening shutter member is positioned on substantially the same plane as, or at a slightly lower level than, the upper surface of the arcuate bottom wall of the body, and the upper surfaces of the engaging projections of the replenishment opening shutter member are positioned on substantially the same plane as, or at a slightly lower level than, the uppermost surface of the top wall of the body; and when the replenishment opening shutter member is turned from the closed position to the open position, the other end of the first notch of the replenishment opening shutter member is positioned at a position not beyond the other end of the first notch of the body in the opening direction.

19. The toner replenishing device of claim 18, wherein the operating lever member is formed from a thin plate having a constant thickness, and comprises a ring-shaped body, and an operating lever extending radially outwardly of the body; the outer peripheral edge of the operating lever member has a slightly smaller radius than the radius of the arcuate wall of the arcuate concave of the body; the inner peripheral edge of the operating lever member is substantially the same in diameter as the inner peripheral surface of the circular wall portion of the replenishment opening shutter member; a first notch, a second notch, a third notch, and a fourth notch are formed in the inner peripheral edge; the first notch and the second notch are formed at peripheral positions corresponding to the engaging convexes of the replenishment opening shutter member; the radially outward depth of the first notch and the second notch is set to be the same as the thickness of the circular wall portion of the replenishment opening shutter member; the peripheral lengths of the first notch and the second notch are set such that they cannot substantially turn relative to the corresponding engaging convexes of the replenishment opening shutter member; the third notch is formed at a peripheral position between the first notch and the second notch on one side of the ring-shaped member; the peripheral length of the third notch is set at a length which permits the axial movement of the engaging means of the main member; the fourth notch is formed at a peripheral position between the first notch and the second notch on the other side of the ring-shaped member, said peripheral position corresponding to the peripheral position of the first notch of the replenishment opening shutter member; the peripheral length of the fourth notch is set to be substantially the same as the peripheral length of the first notch of the replenishment opening shutter member; the operating lever member has its first notch and second notch engaged with the corresponding engaging convexes of the replenishment opening shutter member fitted turnably in the annular concave of the body, whereby the operating lever member is mounted so as not to be relatively rotatable, with the operating lever member being placed on the upper end surface of the replenishment opening shutter member, the lower surface of the operating lever member radially outward of its part placed on the upper end surface is relatively rotatably borne on the arcuate bottom wall of the arcuate concave of the body, the upper surface of the operating lever member is positioned on substantially the same plane as the upper surfaces of the engaging convexes, one end, on the upstream side in the opening direction, of the third notch of the operating lever member aligns with the one end, on the upstream side in the opening direction, of the second notch of the replenishment opening shutter member, the fourth notch of the operating lever member aligns with the first notch of the replenishment opening shutter member, and the operating lever of the operating lever member is positioned close to one end, on the downstream side in the opening direction, of the arcuate concave of the body, and also positioned, with spacing, above the flat upper surface at a lower level than the arcuate bottom wall of the body.

20. The toner replenishing device of claim 19, wherein the mounting base includes a receiving base; said receiving base has a mounting plate extending horizontally, and a concave extending from the mounting plate vertically downwardly; said mounting plate having opposite ends aligning in terms with a peripheral position with the opposite ends of the arcuate concave of the body, and an arcuate portion formed between the opposite ends; said concave has a cylindrical portion, and a bottom wall extending horizontally at the lower end of the cylindrical portion; a passage opening and a through-hole are formed in the bottom wall; said through-hole has a diameter which enables the minor diameter portion of the locking pin member to be removably fitted into the through-hole; the outside diameter of the cylindrical portion is set to be smaller than the inside diameter of the circular wall portion of the replenishment opening shutter member; a first notch and a second notch, an engaging convex, and a first slit and a second slit are formed in the cylindrical portion; the first notch and the second notch are arranged at symmetrical positions with respect to the axis center of the cylindrical portion, and each extend from the upper end of the cylindrical portion toward the bottom wall of the receiving base with a predetermined peripheral width; said engaging convex comprises side walls extending radially outwardly from the opposite ends in the peripheral direction of the first notch, an arcuate wall extending between the outer ends in the radial direction of the side walls, and a bottom wall extending between the lower ends of the side walls; a projection extending radially inwardly from the inner peripheral surface of the arcuate wall is formed in the arcuate wall; the first slit and the second slit extend from one end of the first notch and one end of the second notch, respectively, over a predetermined length toward the opening direction of the replenishment opening shutter member; the radially outward depth of the fourth notch of the operating lever member is set at such a size that the fourth notch is turnable relative to the engaging convex of the receiving base; the receiving base is removably mounted, with the replenishment opening shutter member being at the closed position, such that the mounting plate is superposed on the uppermost part of the top wall of the body; and with the receiving base being mounted on the body, the engaging convex of the receiving base is fitted into the first notch of the body and the fourth notch of the operating lever member, whereby the cylindrical portion of the receiving base is positioned relatively turnably inside the circular wall portion of the replenishment opening shutter member and inside the inner peripheral edge of the operating lever member, the lower end of the engaging convex is positioned with a gap from the upper end of the first notch of the replenishment opening shutter member, the second notch of the receiving base is aligned with the second notches of the replenishment opening shutter member and the body as well as the third notch of the operating lever member in terms of the peripheral position, the operating lever of the operating lever member is positioned at a position close to one end, on the downstream side in the opening direction, of the mounting plate, the through-hole of the receiving base is fitted over the minor diameter portion of the locking pin member so as to be relatively movable in the axial direction, and the passage opening of the receiving base is aligned with the toner replenishment opening of the base, with the passage opening being shielded by the bottom wall of the replenishment opening shutter member.

21. The toner replenishing device of claim 20, wherein between the container shutter member and the main member of the toner cartridge, a locking member is disposed so as to be axially movable between a locking position at which it inhibits the relative turning of the container shutter member and the main member and a locking release position at which it allows their relative turning; and the locking member is moved axially upwardly to be brought from the locking position to the locking release position.

22. The toner replenishing device of claim 21, wherein the container shutter member and the main member of the toner cartridge each have a cylindrical portion; the cylindrical portion of the main member is positioned radially inwardly of the cylindrical portion of the container shutter member; a first notch and a second notch extending axially, and a first slit and a second slit are formed in the cylindrical portion of the container shutter member; the first notch and the second notch are arranged at symmetrical positions with respect to the axis center of the cylindrical portion, and each extend from the upper end of the cylindrical portion toward the bottom wall of the container shutter member with a predetermined peripheral width; the first slit and the second slit extend from one end of the first notch and one end of the second notch, respectively, over a predetermined length toward the opening direction of the container shutter member; on the outer peripheral surface of the cylindrical portion of the main member, there are formed an annular concave, a locking engaging piece disposed so as to extend radially outwardly through the first notch and to be relatively movable along the first slit, and a turning engaging piece constituting the engaging means that is disposed so as to extend radially outwardly through the second notch and to be relatively movable along the second slit; said locking member has a body portion formed from an elastic plate member of synthetic resin, having two ends and assuming a spiral shape, and a locking portion formed at one of the ends; said locking member is mounted in the annular concave so as to be deformed in a circular shape in which the ends thereof face each other in a substantially peripheral direction, and the locking portion is positioned in the first notch so as to be movable in the axial direction but substantially immovable in the peripheral direction; and the locking portion is urged axially downwardly because of its elasticity to be brought to the locking position at which it inhibits the movement of the locking engaging piece.

23. The toner replenishing device of claim 22, wherein the locking portion at the locking position, when undergoing a force for directing it axially upwardly against the urging, is moved in the same direction along the notch to be brought to the locking release position at which it permits the movement of the locking engaging piece.

24. The toner replenishing device of claim 22, wherein the locking portion has a locking flange portion extending radially outwardly, and a locking claw portion extending from the locking flange portion axially downwardly; the annular concave includes a pair of flanges extending along the outer peripheral surface of the cylindrical portion of the main member and positioned with spacing in the axial direction; the locking engaging piece, the turning engaging piece, and a notch are formed in one of the flanges positioned at a lower level in the axial direction; the locking engaging piece and the notch formed on the one flange are positioned within the peripheral width of the first notch formed in the cylindrical portion of the container shutter member; the notch formed in the one flange is positioned on the first slit side; the locking position of the locking member is defined by the fitting of the locking claw portion into the notch formed in the one flange; and the locking release position is defined by the axially upward removal of the locking claw portion from the notch formed in the one flange.

25. The toner replenishing device of claim 24, wherein the locking release means of the container shutter member comprises a locking release pin downwardly protruding from the bottom wall of the container shutter member; with the toner cartridge being mounted on the mounting base at the replenishing position, the cylindrical portion of the container shutter member is positioned in the cylindrical portion of the receiving base, the locking engaging piece of the main member and the locking flange portion of the locking member mounted on the main member are positioned in the first notch of the receiving base, the turning engaging piece of the main member is positioned in the second notch of the receiving base and close to the one end, on the upstream side in the opening direction, of the second notch of the replenishment opening shutter member, the locking member mounted on the main member is positioned at the locking release position because the projection formed in the first notch of the receiving base moves the locking flange portion axially upwardly, the locking release pin aligns with the through-hole of the receiving base to move the locking pin member of the body, against the urging force of the spring member, from the locking position at which the locking pin member of the base engages the arcuate notch of the replenishment opening shutter member to the locking release position at which this engagement with the notch is released, and hold the locking pin member in place, the operating lever of the operating lever member is positioned at a position close to one end, on the downstream side in the opening direction, of the mounting plate, and the container of the toner cartridge is turned in the opening direction together with the main member relative to the container shutter member, whereby the main member is turned from the closed position to the open position, the locking engaging piece of the main member is turned along the first slit of the receiving base, the turning engaging piece of the main member is turned along the second slit of the receiving base to turn the replenishment opening shutter member from the closed position to the open position together with the operating lever member, the other ends, on the downstream side in the opening direction, of the first notch of the replenishment opening shutter member and the fourth notch of the operating lever member are turned to a position close to the other end, on the downstream side in the opening direction, of the engaging convex, and the operating lever of the operating lever member is turned to a position close to the other end, on the upstream side in the opening direction, of the mounting plate, whereupon the through-holes of the main member, the passage opening of the container shutter member, the passage opening of the receiving base, the passage opening of the replenishment opening shutter member, and the toner replenishment opening of the base are brought into alignment.

26. The toner replenishing device of claim 25, wherein the container of the toner cartridge is turned in the closing direction together with the main member relative to the container shutter member, whereby the main member is turned from the open position to the closed position, the locking engaging piece of the main member is turned along the first slit of the receiving base, the turning engaging piece of the main member is turned independently of the replenishment opening shutter member and the operating lever member along the second slit of the receiving base to a position close to the other end, on the downstream side in the opening direction, of the third notch of the replenishment opening shutter member, the one end, on the upstream side in the opening direction, of each of the first notch of the replenishment opening shutter member and the fourth notch of the operating lever member are turned to a position close to the one end, on the upstream side in the opening direction, of the engaging convex of the receiving base, whereupon the through-hole of the main member is closed with the bottom wall of the container shutter member, but the passage opening of the receiving base, the passage opening of the replenishment opening shutter member, and the toner replenishment opening of the base are kept in the aligned state.

27. The toner replenishing device of claim 26, wherein the operating lever of the operating lever member is turned from a position close to the other end, on the upstream side in the opening direction, of the mounting plate to a position close to the one end, on the downstream side in the opening direction, of the mounting plate, whereby the replenishment opening shutter member is turned from the open position to the closed position, and the passage opening of the receiving base and the toner replenishment opening of the base are shielded, in a mutually aligned state, by the bottom wall of the replenishment opening shutter member.

28. The toner replenishing device of claim 25, wherein an annular flange overhanging radially outwardly horizontally is formed on the outer peripheral surface of the cylindrical portion of the container shutter member; the rotation inhibiting means comprises a positioning pin disposed so as to protrude upwardly from the receiving base; the rotation inhibited means comprises a positioning hole formed in the flange of the container shutter member so as to be removably engaged with the positioning pin; and the replenishing position is defined by the engagement of the positioning hole with the positioning pin.

29. The toner replenishing device of claim 28, wherein an annular flange is formed on the upper surface of the mounting plate of the receiving base; the inside diameter of the annular flange is formed to be larger than the outside diameter of the circular wall portion of the replenishment opening shutter member; the positioning pin is disposed so as to protrude upwardly from the upper end of the annular flange; and with the toner cartridge being mounted at the replenishing position, the flange of the container shutter member is placed on the upper end of the annular flange of the receiving base.

30. A toner cartridge removably mounted on a mounting base; said mounting base having a toner replenishment opening formed for replenishing a hopper with a toner, and said mounting base being provided with a replenishment opening shutter member mounted so as to be turnable between a closed position at which it closes the toner replenishment opening and an open position at which it opens the toner replenishment opening, and locking means including a locking member movable between a locking position at which it inhibits the turn of the replenishment opening shutter member to hold the replenishment opening shutter member at the closed position, and a locking release position at which it allows the turn; said toner cartridge being removably mounted on said mounting base at a replenishing position at which the toner can be replenished through the toner replenishment opening; wherein said toner cartridge has a container for accommodating the toner, and a shutter mechanism disposed in a lower end part of the container; said shutter mechanism has a main member substantially integral with the container and having a through-hole formed therein, and a container shutter member disposed outside the main member so as to be turnable relative to the main member between a closed position at which it closes the through-hole and an open position at which it opens the through-hole; said container shutter member has rotation inhibited means disposed for engagement with rotation inhibiting means disposed on the mounting base; said container shutter member has locking release means disposed thereon; and said main member has engaging means disposed which can engage engaged means disposed on the replenishment opening shutter member to turn the replenishment opening shutter member;

by engaging the rotation inhibited means of the container shutter member with the rotation inhibiting means of the mounting base, the toner cartridge is mounted at the replenishing position, whereby the locking release means of the container shutter member moves the locking member of the mounting base to the locking release position, and the engaging means of the main member is engaged with the engaged means of the replenishment opening shutter member; and by turning the container relative to the container shutter member, the container shutter member is turned relative to the main member to the open position, the replenishment opening shutter member is turned to the open position, and the through-hole and the toner replenishment opening are aligned with each other.

31. A toner cartridge having engaging means disposed thereon and removably mounted on a mounting base; said mounting base having a toner replenishment opening formed for replenishing a hopper with a toner, and said mounting base being provided with a replenishment opening shutter member mounted so as to be turnable between a closed position at which it closes the toner replenishment opening and an open position at which it opens the toner replenishment opening, and locking means including a locking member movable between a locking position at which it inhibits the turn of the replenishment opening shutter member to hold the replenishment opening shutter member at the closed position, and a locking release position at which it allows the turn; said replenishment opening shutter member having engaged means and an operating lever disposed thereon; said operating lever extending radially outwardly and turnable integrally with the replenishment opening shutter member; said engaged means of the replenishment opening shutter member having an engaged portion to be engaged with the engaging means for an opening-direction turn for turning the replenishment opening shutter member from the closed position to the open position, and a free play space portion for permitting the closing-direction turn of the engaging means independently of the replenishment opening shutter member; said closing-direction turn being performed for turning the replenishment opening shutter member from the open position to the closed position; said closing-direction turn of the replenishment opening shutter member being performed by the operating lever; said toner cartridge being removably mounted on the mounting base at a replenishing position at which the toner can be replenished through the toner replenishment opening; wherein said toner cartridge has a container for accommodating the toner, and a shutter mechanism disposed in a lower end part of the container; said shutter mechanism has a main member substantially integral with the container and having a through-hole formed therein, and a container shutter member disposed outside the main member so as to be turnable relative to the main member between a closed position at which it closes the through-hole and an open position at which it opens the through-hole; said container shutter member has rotation inhibited means disposed for engagement with rotation inhibiting means disposed on the mounting base; said container shutter member has locking release means disposed thereon; and said main member has the engaging means disposed which can engage the engaged means of the replenishment opening shutter member to turn the replenishment opening shutter member;

by engaging the rotation inhibited means of the container shutter member with the rotation inhibiting means of the mounting base, the toner cartridge is mounted at the replenishing position, whereby the locking release means of the container shutter member moves the locking member of the mounting base to the locking release position, and the engaging means of the main member is engaged with the engaged means of the replenishment opening shutter member; and by turning the container relative to the container shutter member, the container shutter member is turned relative to the main member to the open position, the replenishment opening shutter member is turned to the open position, and the through-hole and the toner replenishment opening are aligned with each other.

32. A toner cartridge removably mounted on a mounting base having a toner replenishment opening formed for replenishing a hopper with a toner, said toner cartridge being mounted on the mounting base at a replenishing position at which the toner can be replenished through the toner replenishment opening; said toner cartridge having a container for accommodating the toner, and a shutter mechanism disposed in a lower end part of the container; said shutter mechanism having a main member substantially integral with the container and having a through-hole formed therein, and a container shutter member disposed outside the main member so as to be turnable relative to the main member between a closed position at which it closes the through-hole and an open position at which it opens the through-hole; wherein a locking member is disposed between the container shutter member and the main member so as to be axially movable between a locking position at which it inhibits the relative turning of the container shutter member and the main member and a locking release position at which it allows the relative turning of the container shutter member and the main member, and the locking member is moved axially upwardly to be brought from the locking position to the locking release position.

33. The toner cartridge of claim 32, wherein said container shutter member and said main member each have a cylindrical portion; said cylindrical portion of the main member is positioned radially inwardly of the cylindrical portion of the container shutter member; a notch extending axially, and a slit extending peripherally from the lower end of the notch are formed in the cylindrical portion of the container shutter member; on the outer peripheral surface of the cylindrical portion of the main member, there are formed an annular concave, and a locking engaging piece disposed so as to extend radially outwardly through the notch and to be relatively movable along the slit; said locking member has a body portion formed from an elastic plate member of synthetic resin, having two ends and assuming a spiral shape, and a locking portion formed at one of the ends; said locking member is mounted in the annular concave so as to be elastically deformed in a circular shape in which the ends thereof face each other in substantially the peripheral direction, and the locking portion is positioned in the notch so as to be movable in the axial direction but substantially immovable in the peripheral direction; and said locking portion is urged axially downwardly because of its elasticity to be brought to the locking position at which it inhibits the movement of the locking engaging piece.

34. The toner replenishing device of claim 33, wherein said locking portion at the locking position, when undergoing a force for directing it axially upwardly against the urging, is moved in the same direction along the notch to be brought to the locking release position at which it permits the movement of the locking engaging piece.

35. The toner replenishing device of claim 33, wherein said locking portion has a locking flange portion extending radially outwardly, and a locking claw portion extending from the locking flange portion axially downwardly; said annular concave includes a pair of flanges extending along the outer peripheral surface of the cylindrical portion of the main member and positioned with spacing in the axial direction; said locking engaging piece and a notch are formed in one of the flanges positioned at a lower level in the axial direction; said locking engaging piece and said notch formed on the one flange are positioned within the peripheral width of the notch formed in the cylindrical portion of the container shutter member; said notch formed in the one flange is positioned on the slit side; said locking position is defined by the fitting of the locking claw portion into the notch formed in the one flange; and said locking release position is defined by the axially upward removal of the locking claw portion from the notch formed in the one flange.

36. The toner cartridge of claim 32, wherein an annular flange is formed on the outer peripheral surface of the cylindrical portion of the container shutter member, and rotation inhibited means removably engaged with rotation inhibiting means disposed on the mounting base is disposed on the flange.

* * * * *